US006415112B1

(12) United States Patent
Kimizuka et al.

(10) Patent No.: US 6,415,112 B1
(45) Date of Patent: Jul. 2, 2002

(54) TONER REMAINING AMOUNT DETECTING DEVICE, TONER REMAINING AMOUNT DETECTING METHOD, PROCESS CARTRIDGE AND ELECTROPHOTOGRAPHIC IMAGE FORMING APPARATUS

(75) Inventors: Junichi Kimizuka, Yokohama; Atsuko Adachi, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/944,188

(22) Filed: Sep. 4, 2001

Related U.S. Application Data

(63) Continuation of application No. 09/438,490, filed on Nov. 12, 1999, now abandoned.

(30) Foreign Application Priority Data

Nov. 13, 1998 (JP) ..... 10-323956
Nov. 13, 1998 (JP) ..... 10-324002
Nov. 4, 1999 (JP) ..... 11-313243

(51) Int. Cl.[7] ..... G03G 15/08
(52) U.S. Cl. ..... 399/27
(58) Field of Search ..... 399/119, 120, 399/111, 27, 28, 29, 252, 258, 262, 61; 222/DIG. 1

(56) References Cited

U.S. PATENT DOCUMENTS 4,133,453 A 1/1979 Ohbora ..... 222/39
5,198,860 A 3/1993 Yamanaka et al.
5,465,619 A 11/1995 Sotack et al. ..... 73/304 C
5,638,161 A 6/1997 Numagami et al. ..... 399/111
5,689,774 A 11/1997 Shishido et al. ..... 399/111
5,873,012 A 2/1999 Miyabe et al. ..... 399/90
5,899,607 A 5/1999 Kawaguchi et al. ..... 399/254
5,946,522 A 8/1999 Inami ..... 399/27
5,953,560 A 9/1999 Numagami et al. ..... 399/111
5,974,288 A 10/1999 Sato ..... 399/119
5,987,269 A 11/1999 Allen et al. ..... 399/27
6,029,031 A 2/2000 Yokomori et al. ..... 399/109
6,035,150 A 3/2000 Domon et al. ..... 399/27
6,253,036 B1 6/2001 Karakama et al. ..... 399/27

FOREIGN PATENT DOCUMENTS

JP 55-50273 4/1980
JP 57-154268 9/1982
JP 2-712033 10/1997
JP 2000-122397 4/2000
JP 2000-122398 4/2000

*Primary Examiner*—Susan S. Y. Lee
(74) *Attorney, Agent, or Firm*—Fitzpatrick, Cella, Harper & Scinto

(57) ABSTRACT

A toner remaining amount detecting device used for an electrophotographic image forming apparatus to sequentially detect an amount of toner in a toner containing portion, includes a first electrode disposed along a path in which an amount of toner contained in the toner containing portion for containing the toner is decreased upon consumption, a second electrode disposed so that the toner in the toner containing portion can exist between the first and second electrodes when the toner is contained in the toner containing portion, and a capacitance-detecting device for sequentially detecting a change in capacitance between the first and second electrodes, wherein the amount of the toner in the toner containing portion is detected sequentially.

36 Claims, 19 Drawing Sheets

TONER REMAINING AMOUNT DETECTING DEVICE, TONER REMAINING AMOUNT DETECTING METHOD, PROCESS CARTRIDGE AND ELECTROPHOTOGRAPHIC IMAGE FORMING APPARATUS

CROSS REFERENCE TO RELATED APPLICATION

This application is a continuation of application Ser. No. 09/438,490, filed Nov. 12, 1999, now abandoned.

BACKGROUND OF THE INVENTION

1. Field of the Invention

The present invention relates to a toner remaining-amount detecting device, a toner remaining-amount detecting method, a process cartridge and an electrophotographic image forming apparatus, in which change in an amount of toner, which is decreased upon consumption, can be detected sequentially.

The process cartridge is a cartridge into which at least developing means and an electrophotographic photosensitive member are integrally made, and which is detachably mountable to a main body of an electrophotographic image forming apparatus.

The electrophotographic image forming apparatus serves to form an image on a recording medium (for example, recording paper, cloth or the like) by using an electrophotographic image forming process and may include, for example, an electrophotographic copying machine, an electrophotographic printer (for example, an LED printer, a laser beam printer or the like), an electrophotographic facsimile and an electrophotographic word processor.

2. Related Background Art

Conventionally, in electrophotographic image forming apparatuses using an electrophotographic image forming process, a latent image formed on a photosensitive drum has been developed by toner. In order to detect a remaining amount of toner, capacitance, which is varied with an amount of toner existing between electrodes, has been detected (refer to Japanese Patent No. 2712033).

In the conventional toner remaining-amount detecting methods and systems, a remaining amount of toner contained within a toner containing portion could not detected sequentially.

SUMMARY OF THE INVENTION

An object of the present invention is to provide a toner remaining-amount detecting device, a toner remaining-amount detecting method, a process cartridge and an electrophotographic image forming apparatus, in which a remaining amount of toner can be detected sequentially.

Another object of the present invention is to provide a toner remaining-amount detecting device, a toner remaining-amount detecting method, a process cartridge and an electrophotographic image forming apparatus, in which a remaining amount of toner can be detected by using change in capacitance.

A further object of the present invention is to provide a toner remaining-amount detecting device, a toner remaining-amount detecting method, a process cartridge and an electrophotographic image forming apparatus, in which there are provided a first electrode disposed along a path in which the amount of toner contained in a toner containing portion for containing the toner is decreased upon consumption, and a second electrode disposed so that the toner in the toner-containing portion can exist between the first and second electrodes when the toner is contained in the toner-containing portion, and in which an amount of the toner in the toner-containing portion can be detected sequentially.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

The present invention will now be explained in connection with embodiments thereof with reference to the accompanying drawings.

First Embodiment

Figure 2:
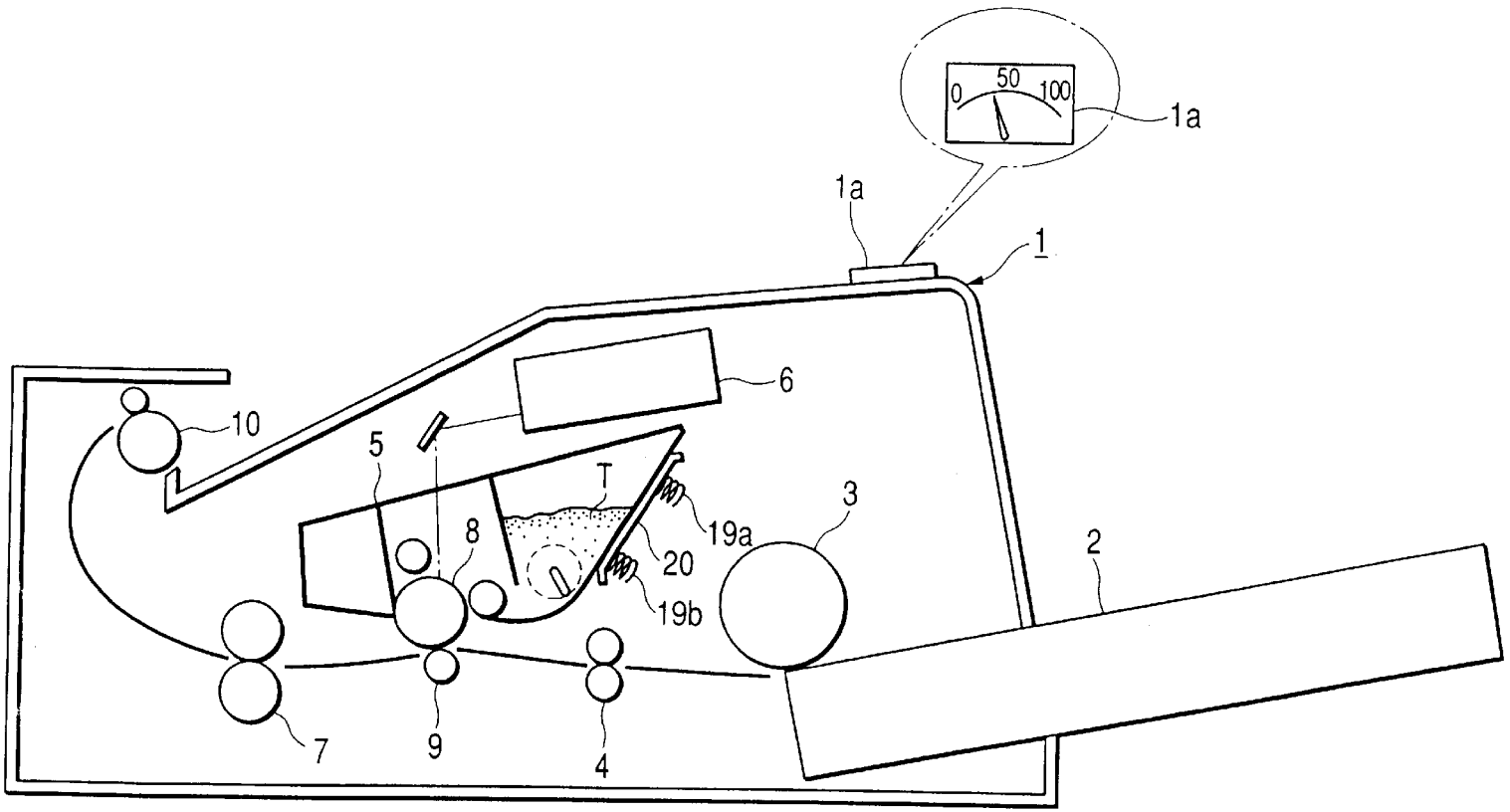
FIG. 2 is a sectional view of an image forming apparatus (laser printer) having a toner remaining-amount detecting device according to the first embodiment of the present invention.

FIG. 2 is a sectional view of an image forming apparatus (laser printer) having a toner remaining-amount detecting device according to the present invention. In FIG. 2, the image forming apparatus includes a sheet cassette 2, a pick-up roller 3, a pair of registration rollers 4, a process cartridge 5, a laser scanner unit 6, and a fixing device 7.

An image signal for image formation is applied to a laser of the laser scanner unit 6, and a light beam from the laser is scanned by a polygon mirror to form a latent image on a photosensitive drum 8 in the process cartridge 5. The latent image is then developed by a developing device to be visualized as a toner image.

On the other hand, a sheet is picked up from the sheet cassette 2 by the pick-up roller 3 and is fed to the photosensitive drum 8 at a predetermined timing controlled by the pair of registration rollers 4. Then, the toner image developed on the photosensitive drum 8 is transferred onto the sheet by a transfer roller 9. The sheet on which the toner image is transferred is sent to the fixing device 7, where the toner image is fixed to the sheet. Thereafter, the sheet is discharged out of the apparatus by a discharge roller 10.

Figure 1:
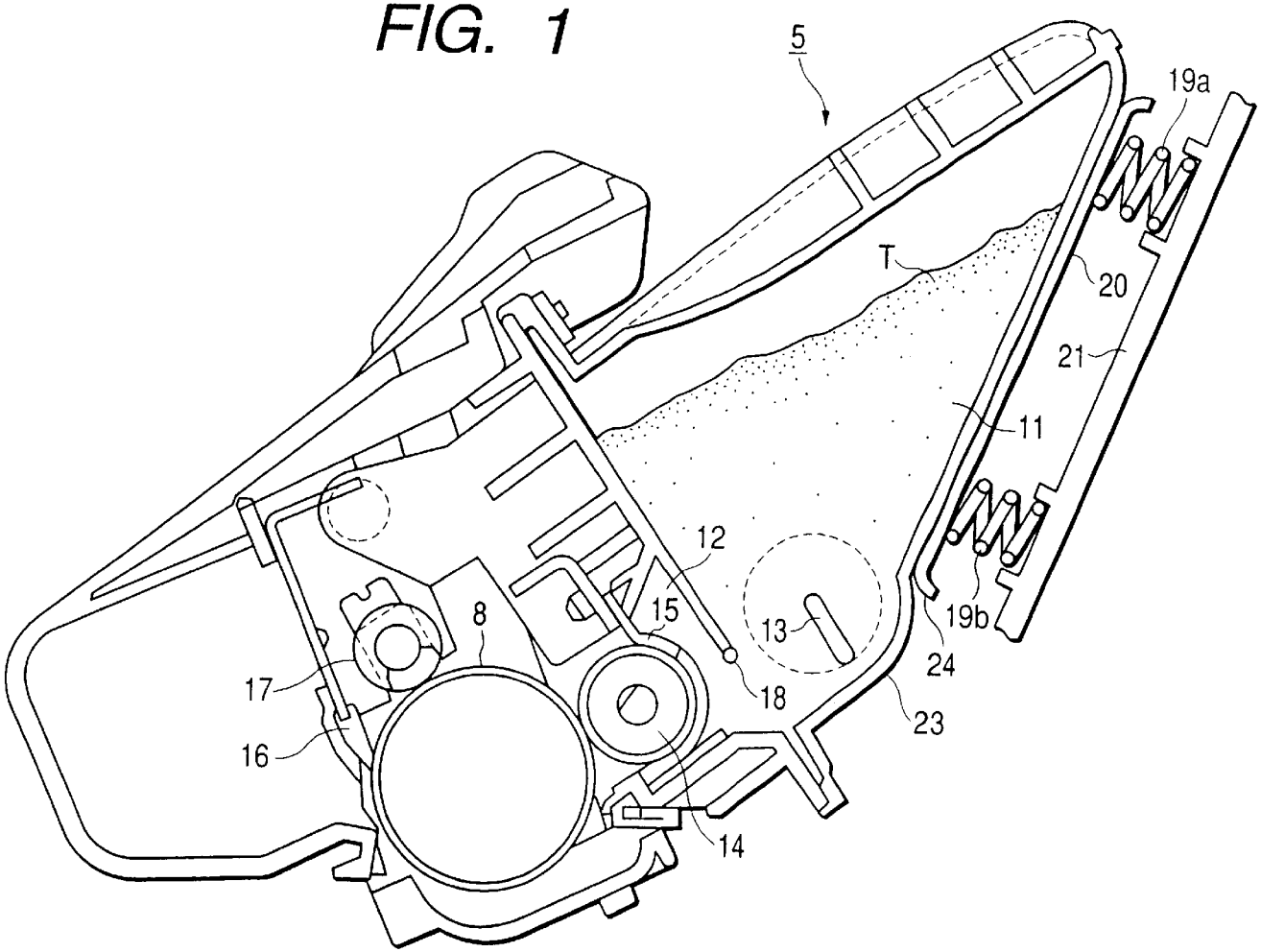
FIG. 1 is a sectional view of a process cartridge having a toner remaining-amount detecting device according to a first embodiment of the present invention.

FIG. 1 is a sectional view of the process cartridge 5 having a toner remaining-amount detecting device according to the present invention.

In FIG. 1, the process cartridge 5 includes a toner container 11 for containing toner T, a developing chamber 12, a toner-agitating rod 13 for agitating the toner T and for feeding the toner to the developing chamber 12, and a developing cylinder 14. The developing cylinder 14 includes a magnet therein, and a rotatable aluminum cylinder (developing sleeve) surrounds the magnet. The developing cylinder 14 is opposed to the photosensitive drum 8 with a small gap therebetween, and a thickness of a toner layer on the developing cylinder 14 is controlled by a doctor blade 15.

A cleaner blade 16 serves to remove residual toner from the photosensitive drum 8, and a charging roller 17 serves to charge a surface of the photosensitive drum 8.

A first antenna 18 formed from piano wire serves to detect the amount of the toner in the developing chamber 12 and is attached to a plastic wall defining the developing chamber 12.

A second antenna 20 is closely contacted to the other wall of the toner container 11 and is formed from a rectangular electrode plate. Springs 19*a*, 19*b* retained by a side wall 21 of the image forming apparatus 1 are biasing members for urging the second antenna 20 and also serve as conductive connection members to the second antenna 20. Incidentally, the developing cylinder 14 and the second antenna 20 cooperate to detect the amount of the toner existing in the toner container 11 on the basis of the change in capacitance.

In FIG. 2, toner remaining-amount displaying (informing) means la serve to display the remaining amount of the toner T within a range from 100% to 0%. However, for example, a remaining amount of toner T of 50% to 0% or 30% to 0% may be displayed. Further, display of 0% (toner remaining amount) does not exactly mean that there is no toner T at all. In the illustrated embodiment, "0%" is displayed when the amount of toner is decreased to the extent that an image having predetermined image quality cannot be obtained. However, the present invention is not limited to such an example.

By the way, when the process cartridge 5 is dismounted from the image forming apparatus 1, the entire process cartridge 5 is lifted above the image forming apparatus 1. In this case, the second antenna 20 is pushed down by a protruded portion 23 of an outer wall of the process cartridge 5 near the agitating rod 13. Incidentally, an end 24 of the second antenna 20 is curved so that such an end is not caught by the outer wall of the process cartridge 5 in this case.

If a distance between the developing cylinder 14 and the second antenna 20 is changed, capacitance therebetween is also changed, and this change becomes an error when the toner-remaining amount is detected.

To avoid this, in the illustrated embodiment, the second antenna 20 is closely contacted with the outer wall of the toner container 11 by the springs 19*a*, 19*b* to prevent dispersion of the capacitance between the developing cylinder 14 and the second antenna 20, thereby permitting correct measurement of the amount of toner remaining in the toner container 11.

Now, a circuitry of the toner remaining-amount detecting device according to the present invention will be explained with reference to FIG. 3.

Figure 3:
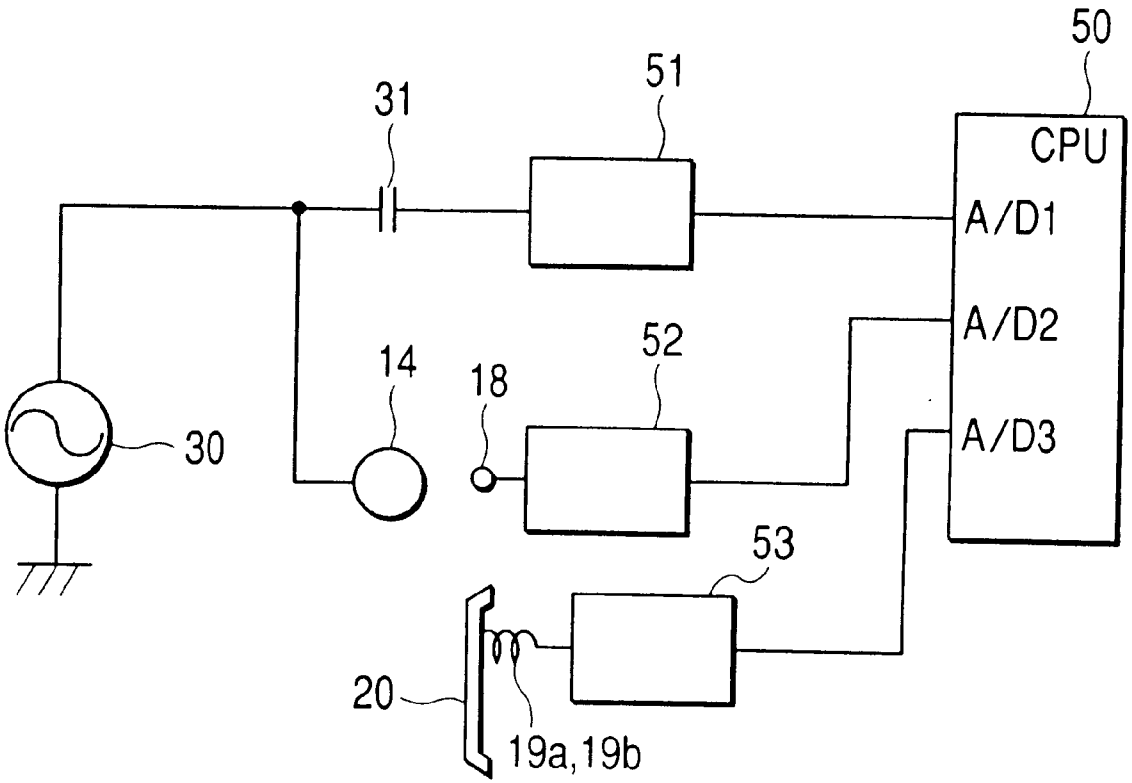
FIG. 3 is a circuit diagram of the toner remaining-amount detecting device according to the first embodiment of the present invention.

FIG. 3 is a circuit diagram of the toner remaining-amount detecting device. In FIG. 3, a high-voltage power supply (developing bias AC power supply) 30 serves to apply high voltage having AC rectangular waveform to the developing cylinder 14, and the applied AC rectangular wave has a frequency of several hundreds Hz to 3 kHz, approximately, and is formed by amplifying a signal generated by a rectangular wave oscillator and by boosting it by a transformer. If necessary, the developing density is adjusted by superimposing a DC voltage on the AC voltage. The AC high voltage generated by the developing-bias AC power supply 30 has the function of causing the toner T of the thin layer on the surface of the developing cylinder 14 to jump toward the photosensitive drum 8 and for attracting the toner T not adsorbed by the photosensitive drum 8 by an electrostatic force back to the developing cylinder 14.

The capacitance of a reference capacitor 31 as a high-voltage proof condenser is selected to be substantially the same as the capacitance between the developing cylinder 14 and the first antenna 18.

Circuits 51 to 53 serve to rectify and integrate the differentiated output of the developing bias AC power supply 30, and the output voltage values of the circuits are varied with magnitude of the capacitance between the reference capacitor 31 or the developing cylinder 14 and the first antenna 18, or, between the springs 19*a*, 19*b* and the second antenna 20.

Pulse voltages detected from the first and the second antennas 18, 20 are converted into DC voltages, which are proportional to amounts of toner in the developing chamber 12 and the toner container 11 respectively. These DC voltages are supplied to analog/digital converting ports A/D1 to A/D3 of a one-chip CPU 50.

By the way, the output passing through the reference capacitor 31 becomes proportional to the fluctuation of the output of the developing bias AC power supply 30. Although it is desirable that the output of the developing bias AC power supply 30 is stable, the amplitude and rising property of the output are slightly changed from machine to machine or due to the change in load capacity, and such change leads to a fluctuation in output of the first antenna 18 and the second antenna 20. Such fluctuation causes an error when the toner-remaining amount is detected. Therefore, when the change in AC voltage is detected through the reference capacitor 31 and when the antenna outputs are measured on the basis of a value obtained by converting the measured result into a DC voltage, the change in the AC voltage itself can be cancelled.

To this end, in the CPU 50, on the basis of the voltage inputted to the input terminal A/D1, the difference between voltages inputted to the input terminals A/D2 and A/D3 is regarded as the true toner-remaining amount.

Second Embodiment

Figure 4:
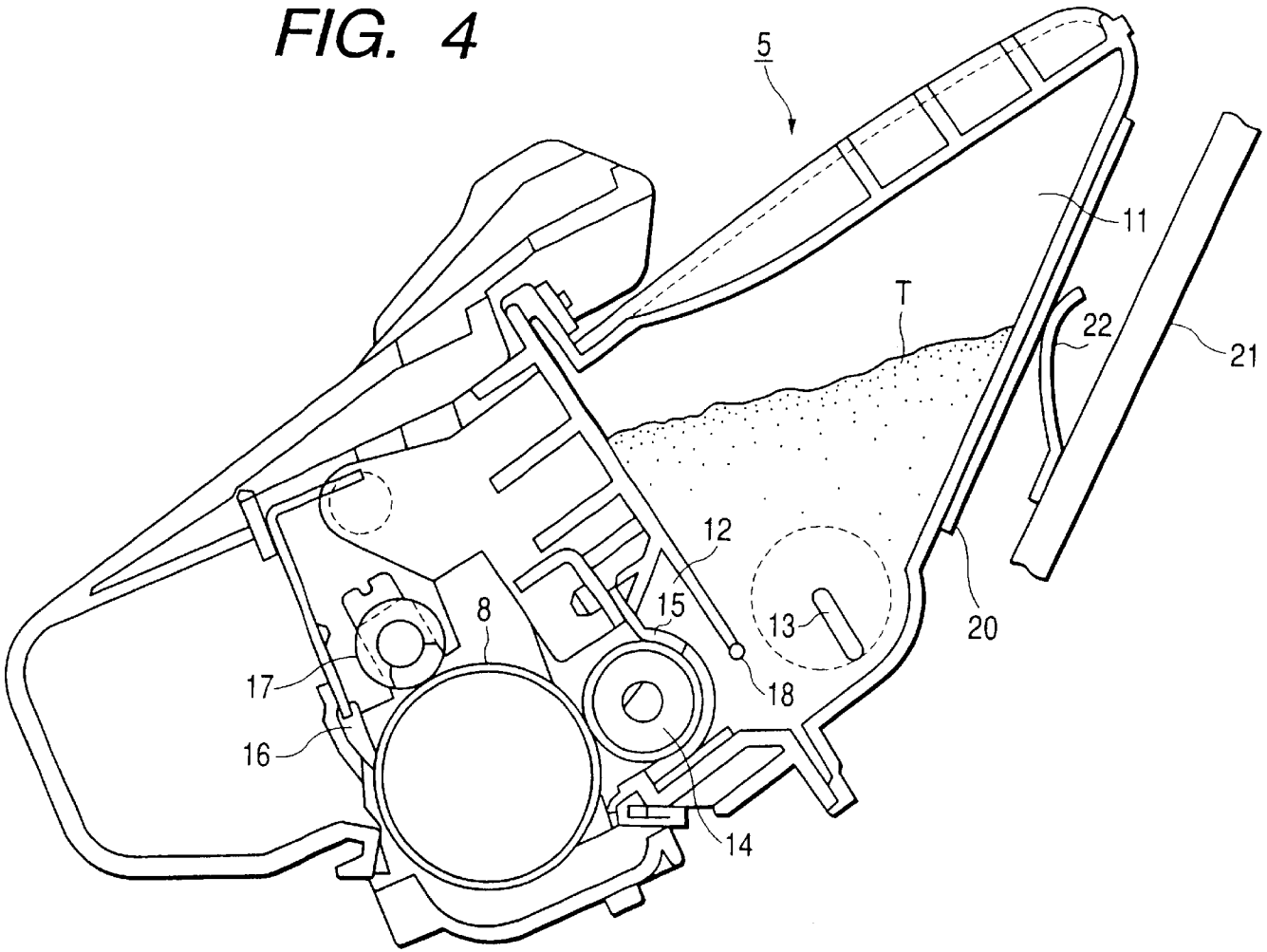
FIG. 4 is a sectional view of a process cartridge having a toner remaining-amount detecting device according to a second embodiment of the present invention.

Next, a second embodiment of the present invention will be explained with reference to FIG. 4. Incidentally, FIG. 4 is a sectional view of a process cartridge having a toner-remaining-amount detecting device according to the second embodiment of the present invention. In FIG. 4, the same elements as those shown in FIG. 1 are designated by the same reference numerals and an explanation thereof will be omitted.

In the first embodiment, while an example that the second antenna 20 is urged by the springs 19*a*, 19*b* from the main body of the apparatus was explained, in the second embodiment, the second antenna 20 is adhered to the outer wall of the process cartridge 5 by an adhesive. A metallic leaf spring 22 held on a wall 21 of the main body is contacted with the second antenna 20 to establish a conductive path for the second antenna 20.

In the illustrated embodiment, since the second antenna 20 is adhered to the outer wall of the process cartridge 5, a distance between the second antenna 20 and the developing cylinder 14 is maintained to a constant value correctly, so that the capacitance therebetween is also maintained correctly, thereby correctly measuring the remaining amount of toner in the toner container 11.

Incidentally, since the leaf spring 22 is urged toward the wall 21 of the main body when the process cartridge 5 is dismounted, the mounting and dismounting of the process cartridge 5 cannot be obstructed by the leaf spring 22.

Third Embodiment

Figure 5:
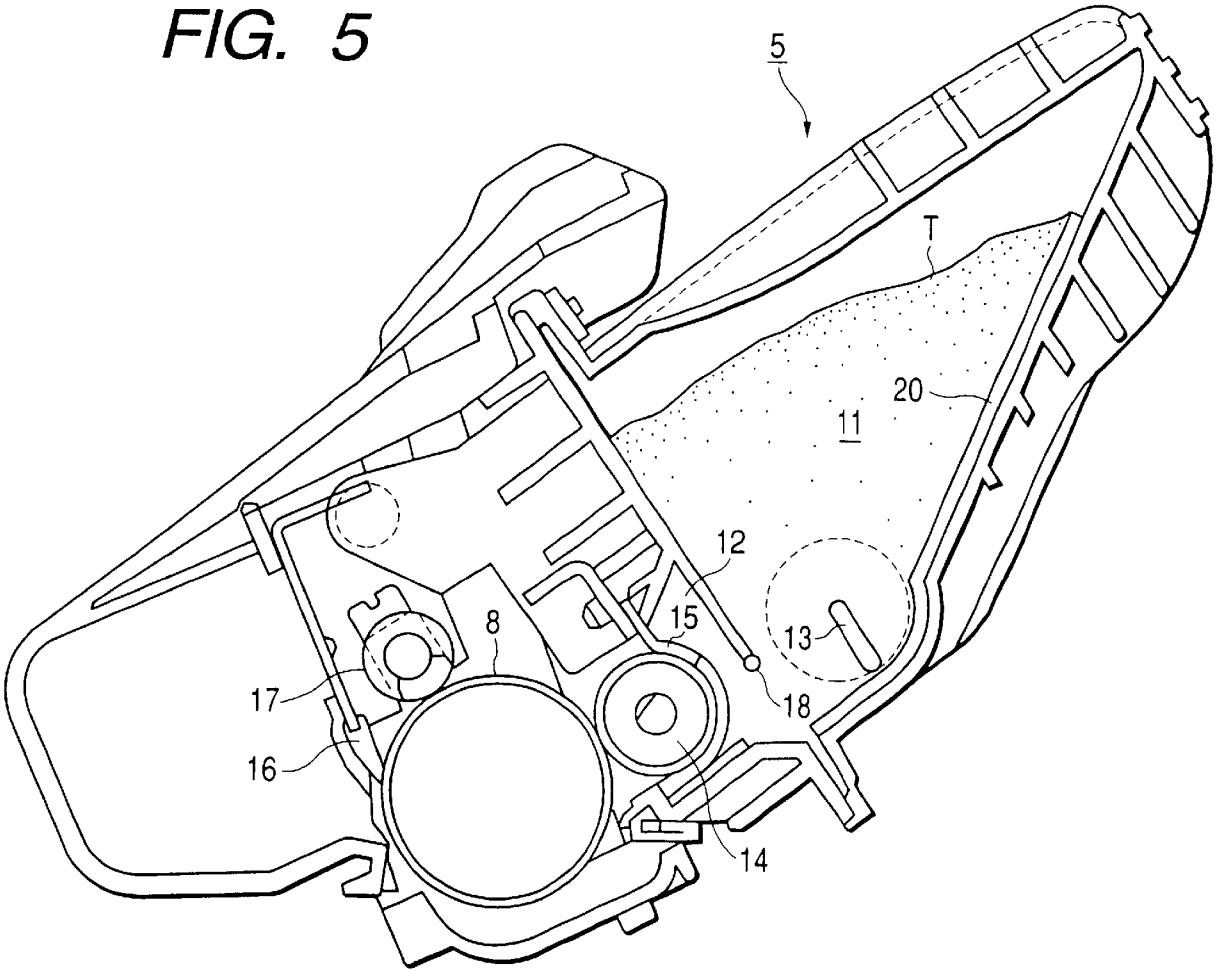
FIG. 5 is a sectional view of a process cartridge having a toner remaining-amount detecting device according to a third embodiment of the present invention.
Figure 6:
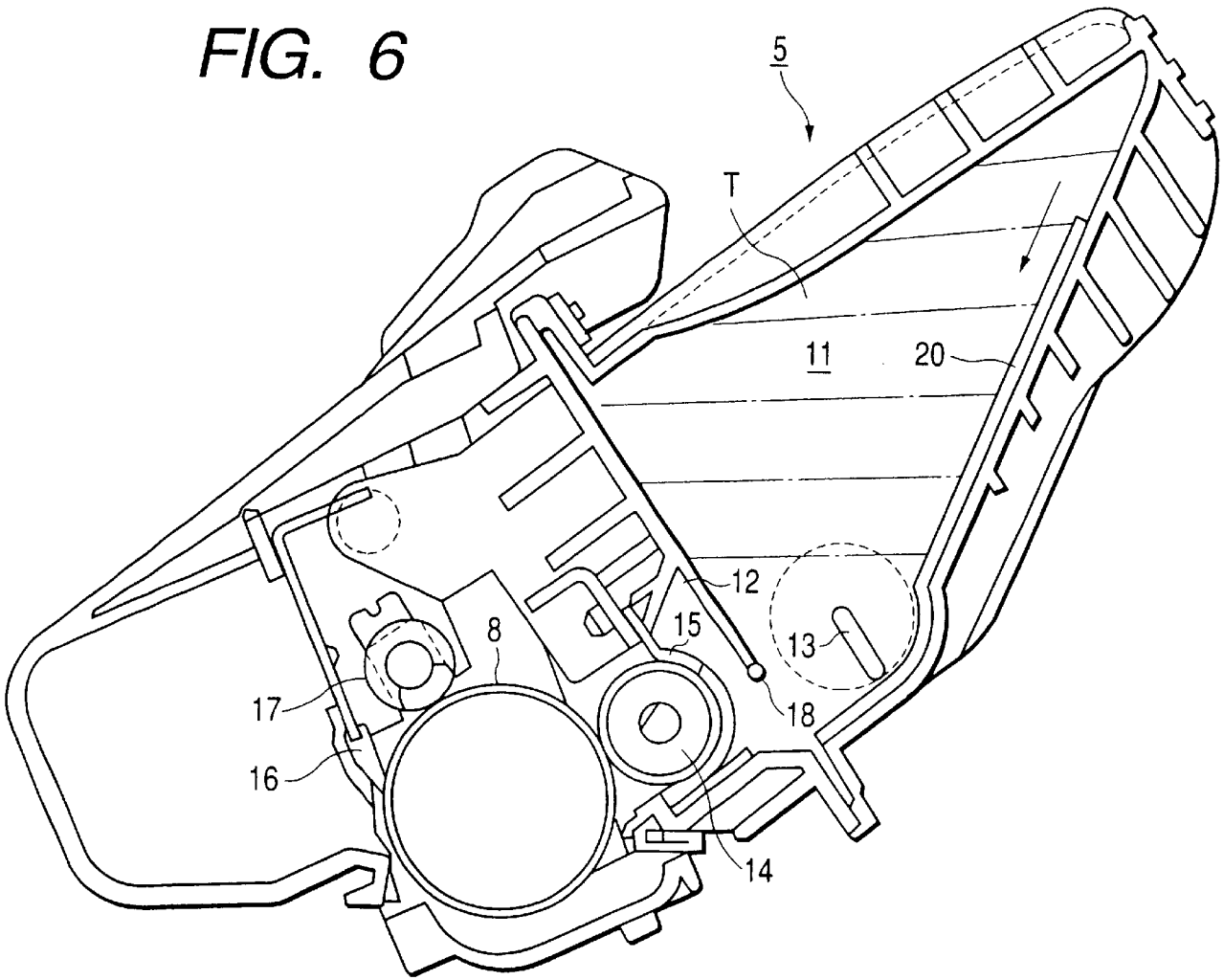
FIG. 6 is a sectional view showing the manner that an amount of toner is decreased in the process cartridge having the toner remaining-amount detecting device according to the third embodiment of the present invention.
Figure 7:
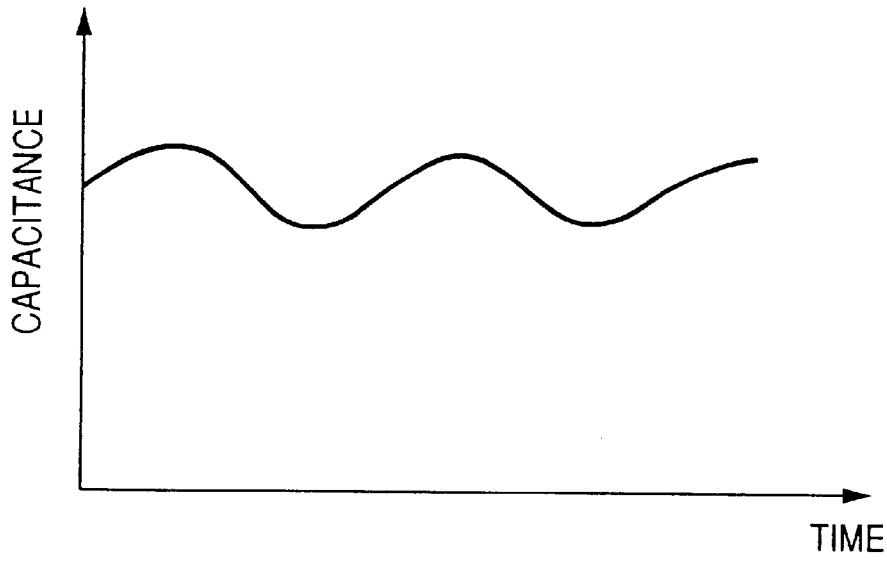
FIG. 7 is a graph showing the relationship between time and capacitance of a second antenna of the toner remaining amount detecting device according to the third embodiment of the present invention.
Figure 8:
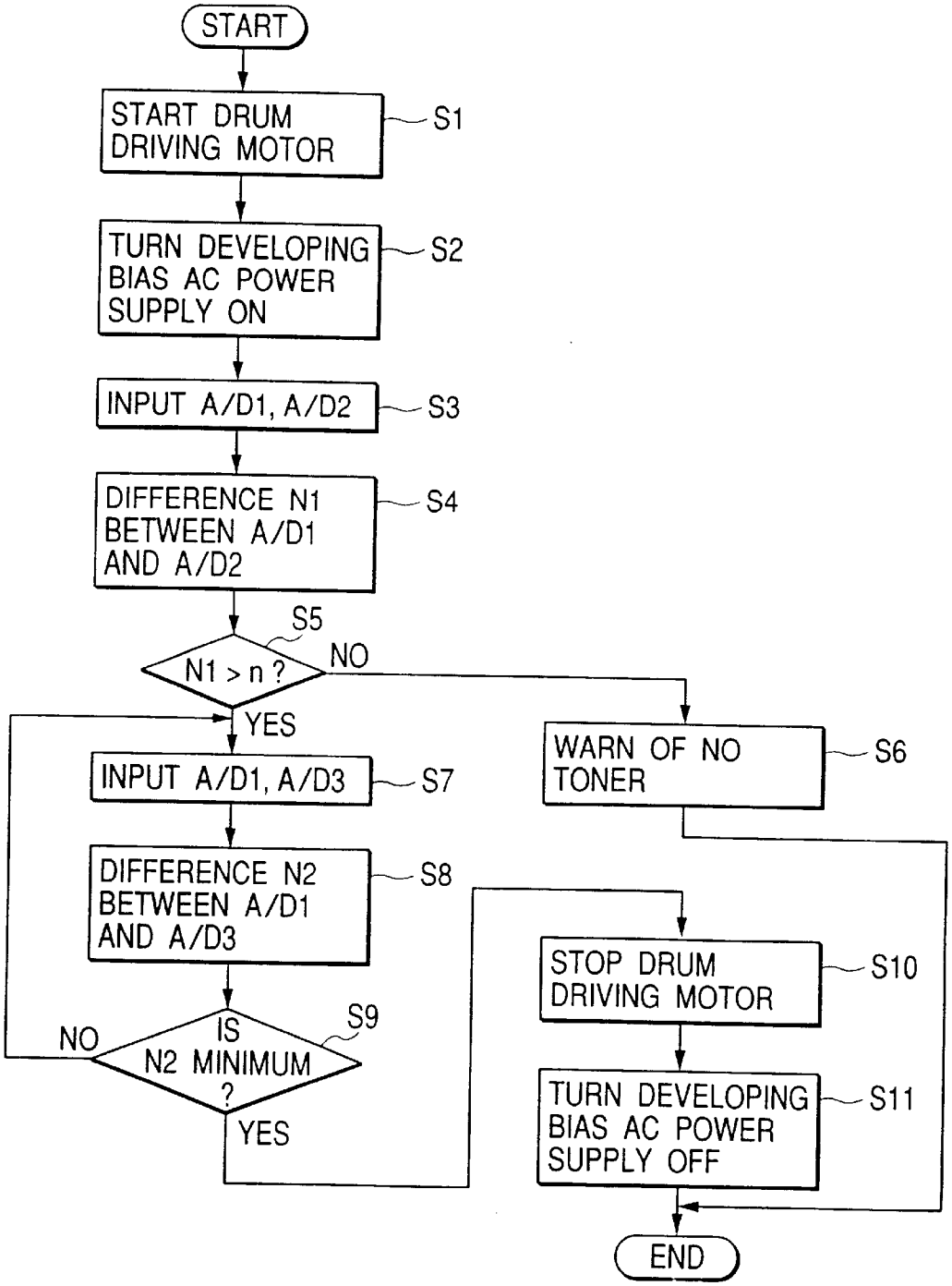
FIG. 8 is a flowchart showing a toner remaining-amount detecting sequence in the toner remaining-amount detecting device according to the third embodiment of the present invention.

Next, a third embodiment of the present invention will be explained with reference to FIGS. 5 to 8. Incidentally, FIGS. 5 and 6 are sectional views of a process cartridge having a toner-remaining-amount detecting device according to the third embodiment of the present invention, FIG. 7 is a view showing a relationship between time and capacitance, and FIG. 8 is a flowchart showing a toner-remaining-amount detecting sequence. In FIGS. 5 and 6, the same elements as those shown in FIG. 1 are designated by the same reference numerals and explanation thereof will be omitted.

In the toner-remaining-amount detecting device according to the third embodiment, as shown in FIG. 5, a second antenna 20 is closely contacted with an inner surface of the toner container 11.

Toner T in the toner container 11 is decreased as shown in FIG. 6. A lateral (horizontal) dot and dash line shown within the toner container 11 in FIG. 6 shows an upper-surface level when the toner T is decreased, and the line is shifted in a direction indicated by the arrow as the amount of toner T is decreased. When the second antenna 20 is disposed along the direction indicated by the arrow, the capacitance detected is decreased as the amount of toner is decreased. Incidentally, the second antenna 20 has a substantially full width in a direction perpendicular to the plane of FIG. 5 or 6.

The greater the length of the toner-decreasing direction (indicated by the arrow in FIG. 6) of the second antenna 20, the greater a range of the change of the capacitance. Further, the detection of the toner-remaining amount is more important when the toner amount is small than when the toner is full.

In consideration of the above, it is required that the second antenna 20 is extended in the vicinity of the toner-agitating rod 13. However, the wall of the toner container 11 near the agitating rod 13 has the radiused portion.

Thus, in the illustrated embodiment, by bending the second antenna 20 along the wall of the toner container 11, the second antenna 20 can be extended up to the end of the toner container 11.

However, at a position where the second antenna 20 is near the toner-agitating rod 13, whenever the rotating toner-agitating rod 13 is getting nearer to and Further away from the second antenna 20, the capacitance detected is changed periodically. Such change in capacitance is shown in FIG. 7.

The change in capacitance coincides with the rotating cyclic period of the toner-agitating rod 13 so that the capacitance becomes maximum (i.e., the detected voltage also becomes a maximum) when the toner-agitating rod 13 is nearest to the second antenna 20 and becomes a minimum (i.e., the detected voltage also becomes minimum) when the toner-agitating rod 13 is most away from the second antenna 20.

In order to detect the toner-remaining amount accurately, the detection should be effected when the influence of the toner agitating rod 13 is minimum.

To this end, in the CPU 50 (refer to FIG. 3), a minimum value of the detected voltage is picked up. Accordingly, when the toner-agitating rod 13 is not rotated, the accurate toner-remaining amount cannot be detected. Further, if the AC component of the developing-bias voltage is not applied to the developing cylinder 14, the toner remaining amount cannot be detected.

Thus, in order to detect the toner remaining amount, it is necessary to rotate the toner-agitating rod 13 and to turn ON the developing bias AC power supply 30 (FIG. 3). In this case, the toner-agitating rod 13 is rotated by one revolution or more without fail.

Now, the toner-remaining-amount detecting sequence will be explained with reference to FIG. 8.

The CPU 50 shown in FIG. 3 is operated in accordance with the flowchart shown in FIG. 8. First of all, a drum driving motor (not shown) is started (step S1). Incidentally, the drum driving motor serves to rotate the photosensitive drum 8 and the elements therearound.

Then, the developing bias AC power supply 30 is turned ON (step S2), and input voltages at the A/D converting ports A/D1, A/D2 are inputted to the CPU 50 (step S3). Then, a difference N1 between A/D1 input voltage and A/D2 input voltage (step S4). Incidentally, the A/D1 voltage is reference voltage, and, by subtracting the A/D1 voltage from the A/D2 voltage, a voltage value N1 proportional to the net capacitance between the developing cylinder 14 and the first antenna 18 can be sought.

After the voltage value N1 is sought in this way, it is judged whether or not the value N1 is greater than a value n indicating no toner (N1>n) (step S5). If it is smaller (N1≦n), a warning of no toner is effected (step S6). On the other hand, if it is greater, input voltages of the A/D converting ports A/D1, A/D3 are inputted (step S7) and a difference N2 therebetween is sought (step S8). The detection is continued until a minimum value of the difference N2 is obtained (step S9). To this end, it is required that the detection be continued until the toner-agitating rod 13 is rotated through at least one revolution.

When the minimum value for N2 is obtained, the minimum value is stored as data for the toner remaining amount of the toner container 11, and the drum driving motor is stopped (step S10). Then, the developing-bias AC power supply 30 is turned OFF (step S11). In this way, the sequence is ended.

Incidentally, while the flowchart of FIG. 8 was shown as a special routine for detecting the toner remaining amount, normally, when the image forming apparatus 1 performs the printing operation, since both the drum driving motor and the developing bias AC power supply 30 are operated, the above-mentioned steps S1, S2, S10 and S11 may not be performed in the detecting routine.

Fourth Embodiment

Figure 9:
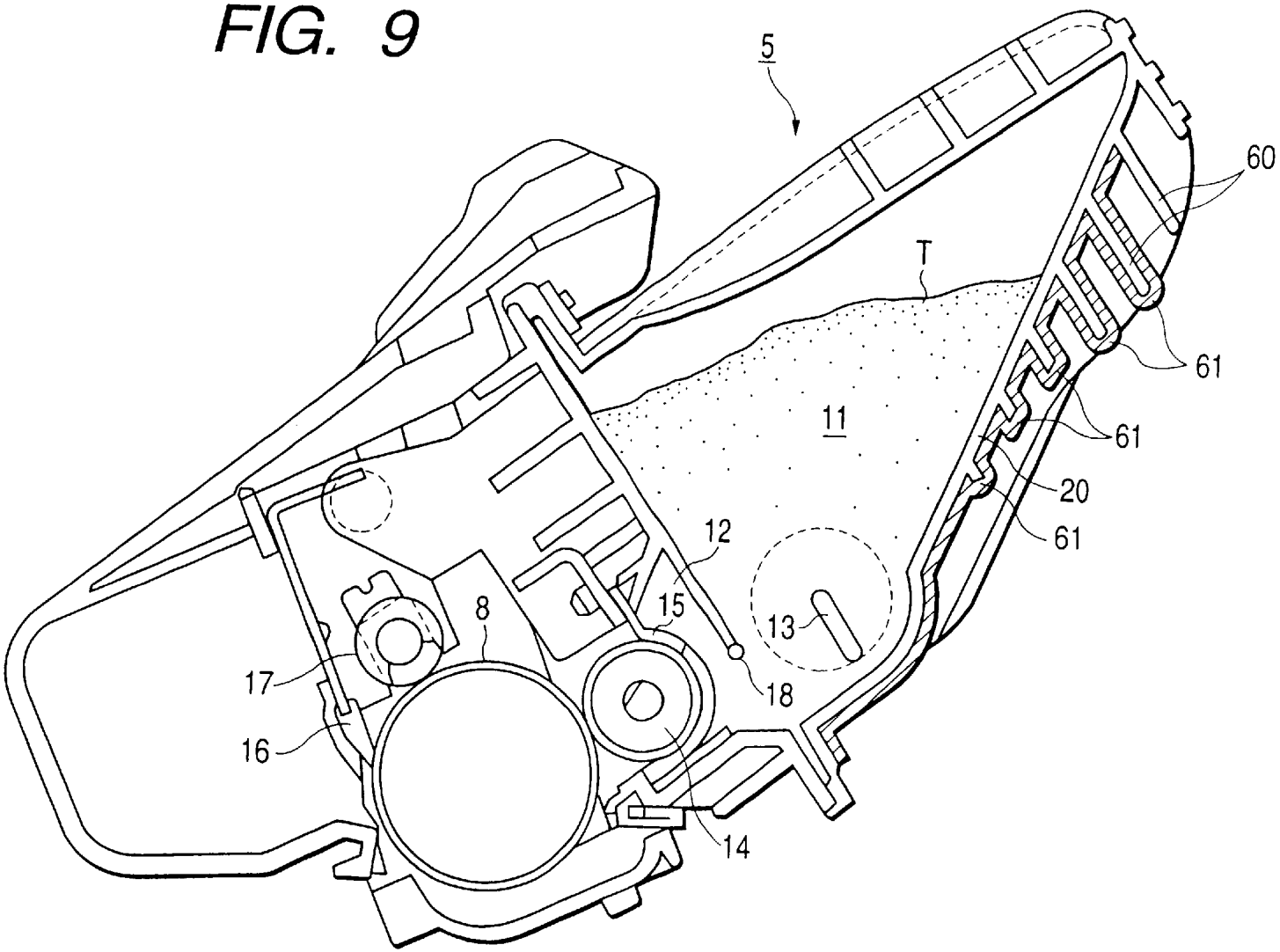
FIG. 9 is a sectional view of a process cartridge having a toner remaining-amount detecting device according to a fourth embodiment of the present invention.
Figure 10:
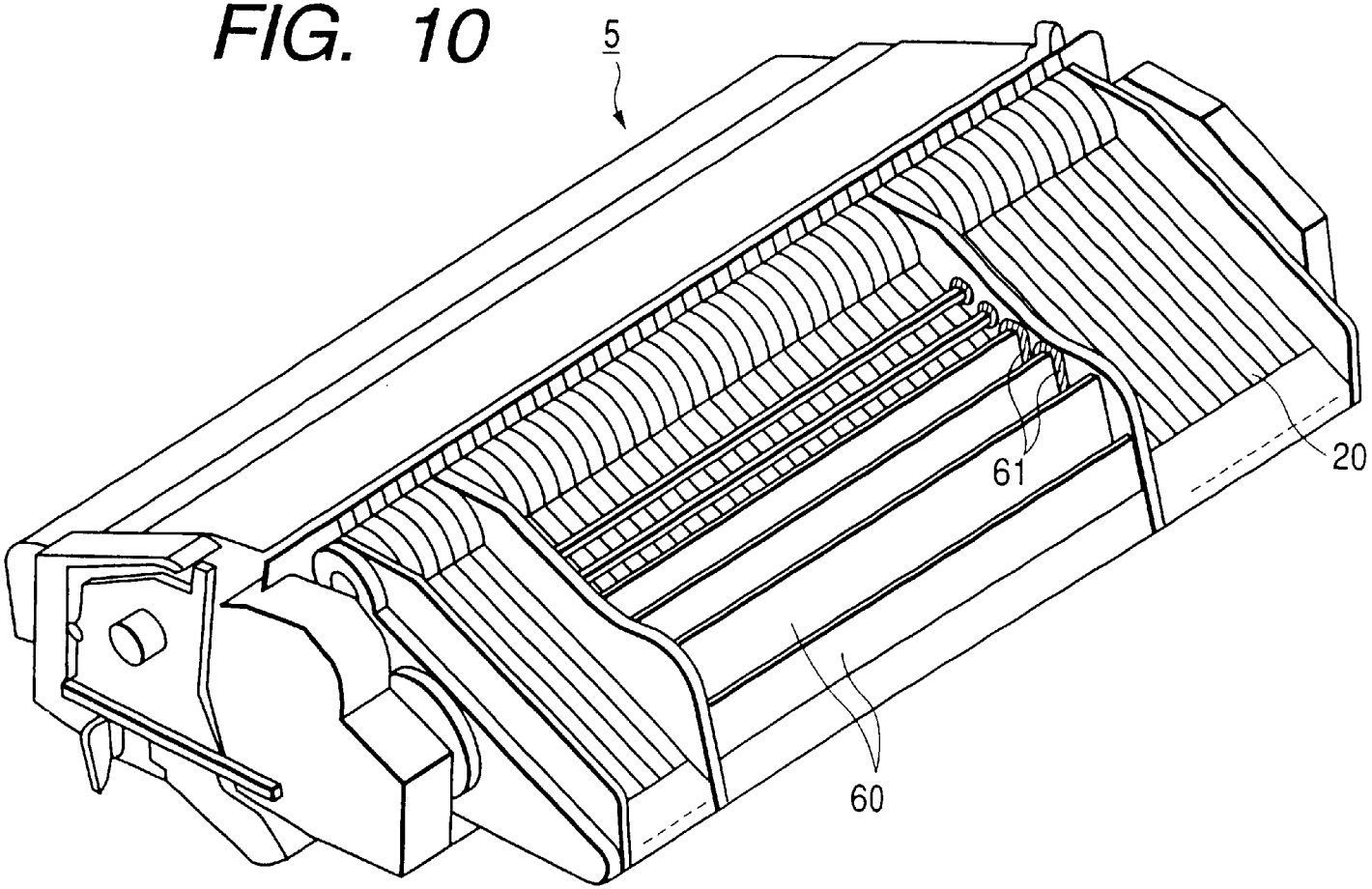
FIG. 10 is a perspective view of a bottom of the process cartridge having the toner remaining-amount detecting device according to the fourth embodiment of the present invention.

Next, a fourth embodiment of the present invention will be explained with reference to FIGS. 9 and 10. Incidentally, FIG. 9 is a sectional view of a process cartridge having a toner-remaining-amount detecting device according to the fourth embodiment of the present invention, and FIG. 10 is a bottom perspective of the process cartridge. In FIG. 9, the same elements as those shown in FIG. 1 are designated by the same reference numerals and explanation thereof will be omitted.

In the above-mentioned first to third embodiment, while an example that the wall of the toner container 11 is substantially flat or slightly curved was explained, if unevenness is formed on the outer wall of the toner container, when a second antenna 20 is closely contacted with the wall of the toner container 11 from outside, such unevenness may be obstruction for such close contact.

As shown in FIG. 9, projections 60 formed on the wall of the toner container 11 define a grip of the process cartridge 5 for operator's fingers. To this end, a plurality of projections 60 are formed on the wall of the toner container 11 as rib-shaped unevenness for preventing the operator's fingers from slipping.

In such a case, when the second antenna 20 is provided on the toner container 11 from outside, such unevenness will become an obstruction for close contact between the second antenna and the wall of the toner container. Now, a countermeasure in this case will be explained with reference to FIGS. 9 and 10.

The second antenna 20 for detecting the toner remaining amount is not necessarily made as a single plate, but, even when notches are included in the second antenna, so long as the total area of the notches is small, the influence of the notches upon the total capacitance is negligible.

Thus, as shown by the hatched area in FIG. 9, the second antenna portions are adhered to flat portions of the wall of the toner container 11. And, at the projections 60, as shown in FIG. 10, electrodes 61 are provided at respective end portions of the projections to bridge the adjacent second antenna portions. Incidentally, in FIG. 10, all of the hatched areas are the antenna portions which constitute the second antenna 20.

In this way, even when the wall of the toner container 11 has the unevenness, the second antenna 20 can be provided.

Incidentally, in this fourth and the above-mentioned third embodiment, the reason why the second antenna 20 is closely secured to the wall of the toner container 11 is that, if the second antenna 20 is moved, the distance between the second antenna and the developing cylinder 14 is changed accordingly to change the capacitance, which leads to the error in the toner remaining-amount-detection.

By the way, when the second antenna 20 is provided within the toner container 11 as is in the third embodiment, if the second antenna 20 is floating from the inner wall of the toner container 11, the toner T will enter between the second antenna 20 and the inner wall of the toner container 11, and such toner T cannot be used for development. As is in the fourth embodiment, when the second antenna 20 is adhered to the outerwall of the toner container 11, such inconvenience can be avoided, and, even soft and thin inexpensive metal plate can be used as the second. antenna. Alternatively, the conductive material may be electroplated on the wall of the toner container 11 to form the second antenna 20.

Fifth Embodiment

Figure 11:
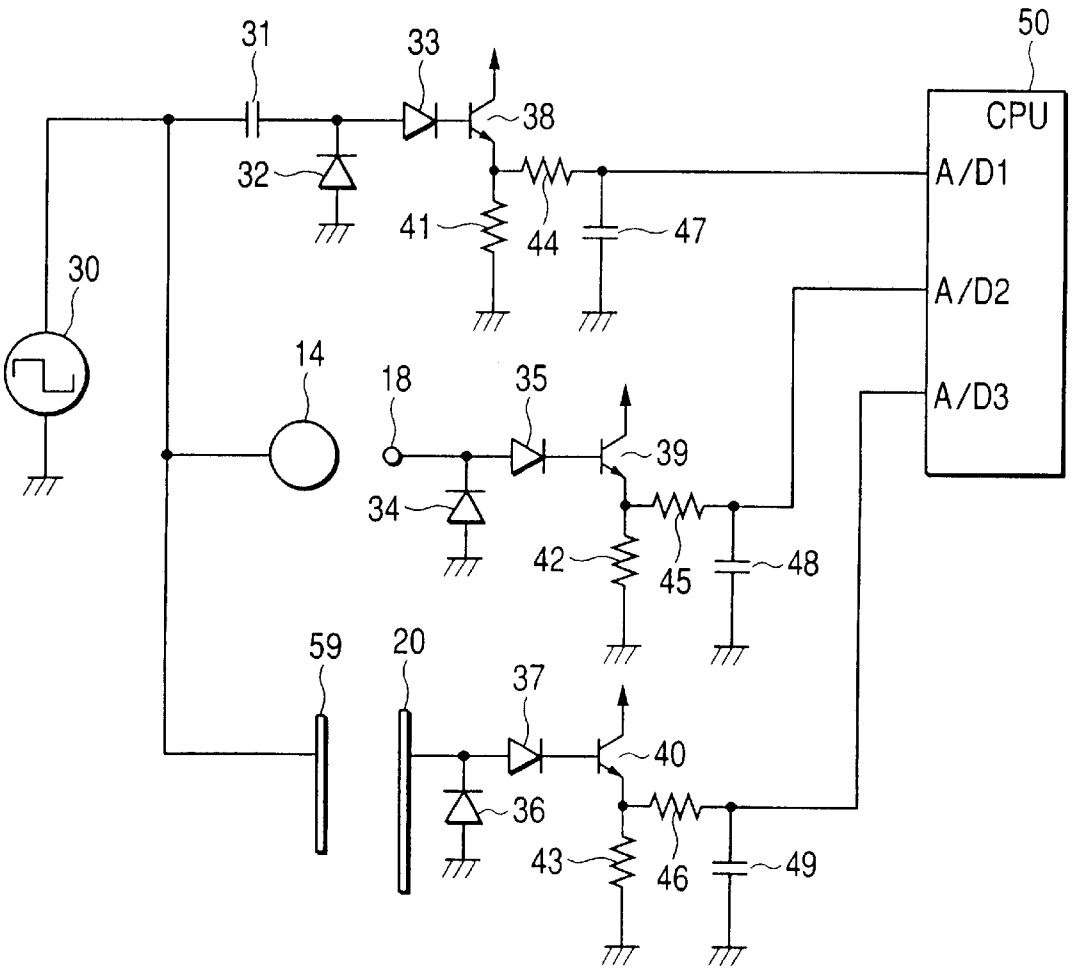
FIG. 11 is a circuit diagram of a toner remaining-amount detecting device according to a fifth embodiment of the present invention.

Next, a fifth embodiment of the present invention will be explained with reference to FIGS. 11 to 13. Incidentally, FIG. 11 is a circuit diagram of a toner-remaining-amount detecting device according to a fifth embodiment of the present invention, FIG. 12 is a sectional view of an image forming apparatus (laser printer) having such a toner-remaining-amount detecting device, and FIG. 13 is a sectional view of a process cartridge having such a toner-remaining-amount detecting device.

Figure 12:
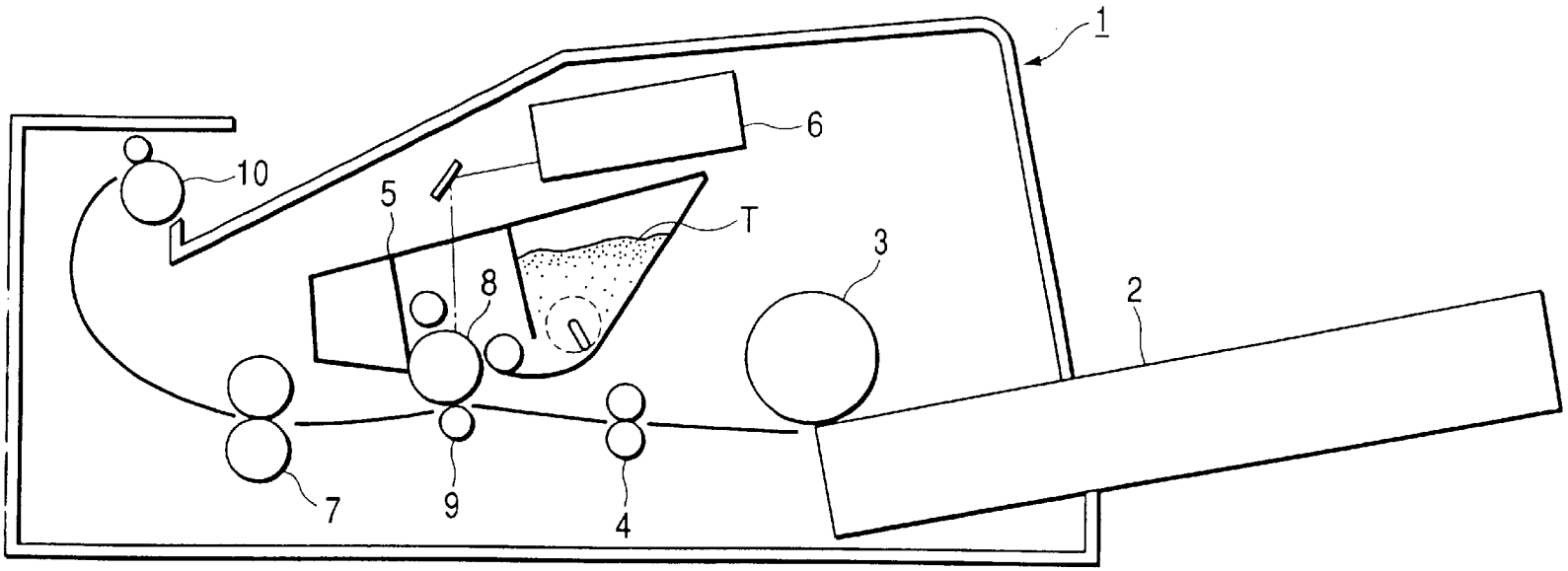
FIG. 12 is a sectional view of an image forming apparatus having the toner remaining-amount detecting device according to the fifth embodiment of the present invention.
Figure 13:
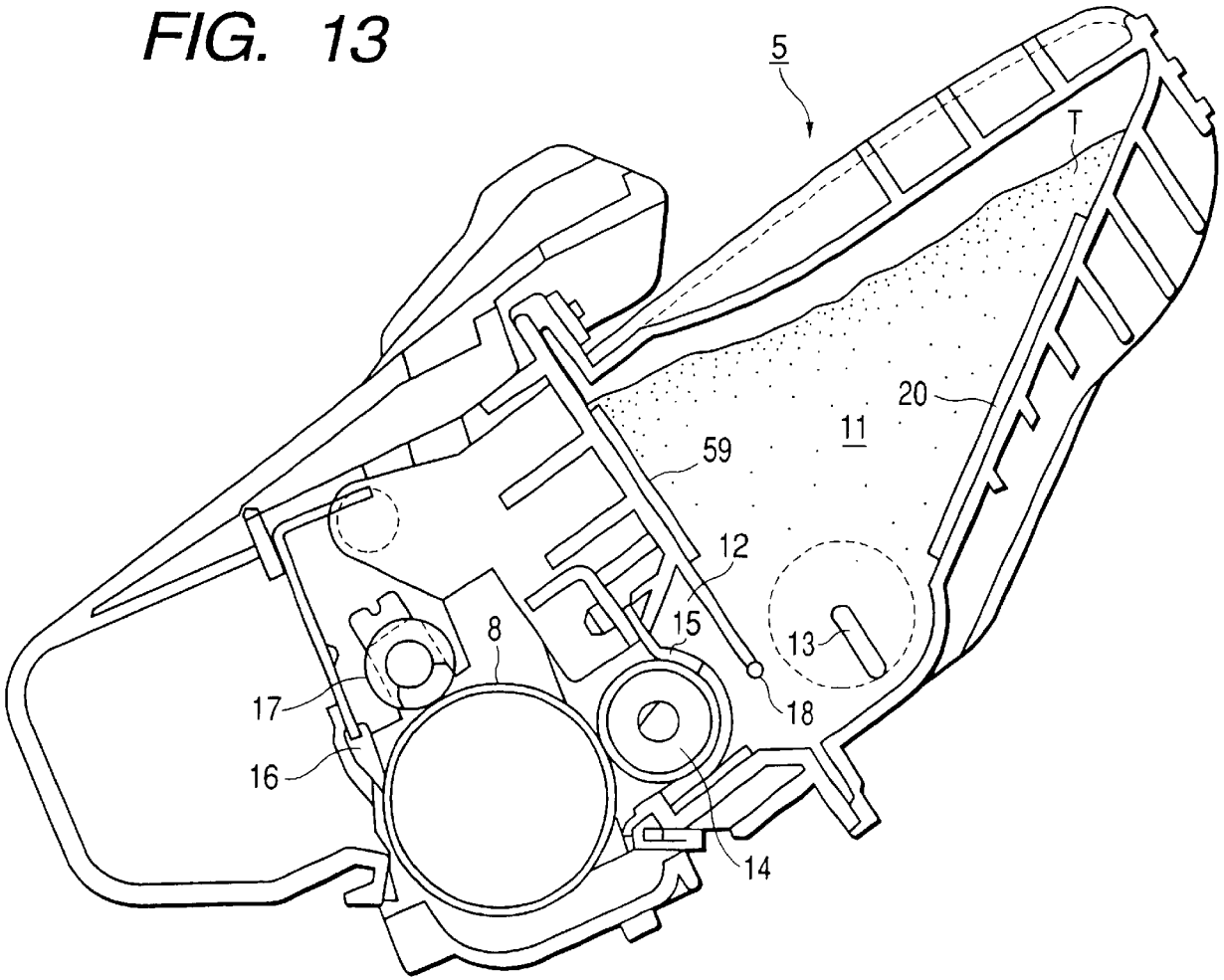
FIG. 13 is a sectional view of a process cartridge having the toner remaining-amount detecting device according to the fifth embodiment of the present invention.

An image forming apparatus 1 shown in FIG. 12 includes a sheet cassette 2, a pick-up roller 3, a pair of registration roller 4, a process cartridge 5, a laser scanner unit 6, and a fixing device 7.

An image signal for image formation is applied to a laser of the laser scanner unit 6, and a light beam from the laser is scanned by a polygon mirror to form a latent image on a photosensitive drum 8 within the process cartridge 5. The invent image is then developed by a developing device to be visualized as a toner image.

On the other hand, a sheet is picked up from the sheet cassette 2 by the pick-up roller 3 and is fed to the photosensitive drum 8 at a predetermined timing controlled by the pair of registration rollers 4. Then, the toner image developed on the photosensitive drum 8 is transferred onto the sheet by a transfer roller 9. The sheet on which the toner image was transferred is sent to the fixing device 7, where the toner image is fixed to the sheet. Thereafter, the sheet is discharged out of the apparatus by a discharge roller 10.

FIG. 13 is a sectional view of the process cartridge 5. In FIG. 13, the process cartridge 5 includes a toner container 11 for containing toner T, a developing chamber 12, a toner-agitating rod 13 for agitating the toner T and for feeding the toner to the developing chamber 12, and a developing cylinder 14. The developing cylinder 14 includes a magnet therein, and a rotating aluminum cylinder (developing sleeve) surrounds the magnet. The developing cylinder 14 is opposed to the photosensitive drum 8 with a small gap, and a thickness of a toner layer on the developing cylinder 14 is controlled by a doctor blade 15.

A cleaner blade 16 serves to remove residual toner from the photosensitive drum 8 after transfer, and a charging roller 17 serves to charge a surface of the photosensitive drum 8.

A first antenna 18 formed from steel wire having great strength, such as piano wire, serves to detect an amount of the toner in the developing chamber 12 and is attached to a plastic wall defining the developing chamber 12.

An electrode plate 59 is attached to a side wall of the toner container 11, and a second antenna 20 is closely adhered to other side wall of the toner container 11 and is formed from a rectangular electrode plate. Incidentally, the electrode plate 59 and the second antenna 20 serve to detect the amount of the toner existing in the toner container 11 on the basis of a change in capacitance.

Now, a circuitry of the toner-remaining-amount detecting device according to the present invention will be explained with reference to FIG. 11.

FIG. 11 is a circuit diagram of the toner-remaining-amount detecting device. In FIG. 11, a high-voltage power supply (developing bias AC power supply) 30 serves to apply high voltage having AC rectangular waveform to the developing cylinder 14, and the AC rectangular wave applied has frequency of several hundreds Hz to 3 kHz, approximately, and is formed by amplifying a signal generated by a rectangular wave oscillator and by boosting it by a transformer. If necessary, the developing density is adjusted by superimposing DC voltage on the AC voltage. The AC high voltage generated by the developing bias AC power supply 30 has a function for causing the toner T of the thin layer on the surface of the developing cylinder 14 to jump toward the photosensitive drum 8 and for attracting the toner T not adsorbed by the photosensitive drum 8 by an electrostatic force back to the developing cylinder 14.

The capacitance of a reference capacitor 31 as a high voltage-proof condenser is selected to be the substantially the same as the capacitance between the developing cylinder 14 and the first antenna 18. Diodes 32 to 37 serve to rectify the differentiated output of the developing bias AC power supply 30. The rectified outputs have pulse waveforms, the crest values of the waveforms are varied with magnitude of the capacitance between the reference capacitor 31 or the developing cylinder 14 and the first antenna 18, or, between the electrode plate 59 and the second antenna 20.

Each of transistors 38 to 40 acts as an emitter follower having a function for converting high impedance at its base into low impedance at its emitter. There are also provided resistors 41 to 46 and capacitors 47 to 49. The capacitors 47 to 49 are peak-holding capacitors for pulse voltages supplied from the transistors 38 to 40, and voltage following to each of the capacitors 47 to 49 becomes DC voltage.

The DC voltages converted from the pulse voltages detected respectively by the first and second antennas 18, 20 become proportional to the amount of toner in the developing chamber 12 and the toner container 11, respectively. The DC voltages are supplied to the analog/digital converting ports A/D1 to A/D3 of the one-chip CPU 50 respectively.

By the way, the output passing through the reference capacitor 31 becomes proportional to the fluctuation of the output of the developing-bias AC power supply 30. Although it is desirable that the output of the developing-bias AC power supply 30 is stable, but the amplitude and rising property of the output are slightly changed from machine to machine or due to a change in load capacity, and such change leads to fluctuation in output between the first antenna 18 and the second antenna 20. Such fluctuation causes an error when the toner remaining amount is detected. Therefore, when the change in AC voltage is detected through the reference capacitor 31 and when the outputs of the first antenna 18 and the second antenna 20 are measured on the basis of a voltage outputted at an end of the capacitor 47, the change in the AC voltage itself can be cancelled.

To this end, in the CPU 50, on the basis of the voltage inputted to the input terminal A/D1, the difference between voltages inputted to the input terminals A/D2 and A/D3 is regarded as the true toner remaining amount.

If the AC voltage applied to the developing cylinder 14 differs from the AC voltage applied to the electrode plate 59, due to the capacitive coupling of capacitance between the electrode plate 59 and the first antenna 18, two kinds of AC voltages are outputted to the first antenna 18, thereby generating a beat frequency corresponding to the difference therebetween. A similar phenomenon occurs in the second antenna 20. As a result, voltages outputted to the ends of the capacitors 48, 49 fluctuate due to the beat frequency, and such fluctuation causes an error in the toner-remaining-amount detection.

However, in the illustrated embodiment, since the voltages having the same frequency are applied to the developing cylinder 14 and the electrode plate 59, even if there is capacitive coupling between the first antenna 18 and the second antenna 20, the beat frequency becomes zero (i.e., direct current). Thus, although the beat frequency component may act as bias against the detection result, since the beat frequency is not fluctuated, there is no dispersion in the detection result. The bias component can easily be removed by subtracting it in the CPU 50, and, since it is not required that two kinds of AC power supplies be prepared, cost can be saved.

From the above result, according to the toner-remaining-amount detecting device of the illustrated embodiment, the remaining amount of toner in the toner container 11 and the developing chamber 12 can be detected accurately.

Sixth Embodiment

Figure 14:
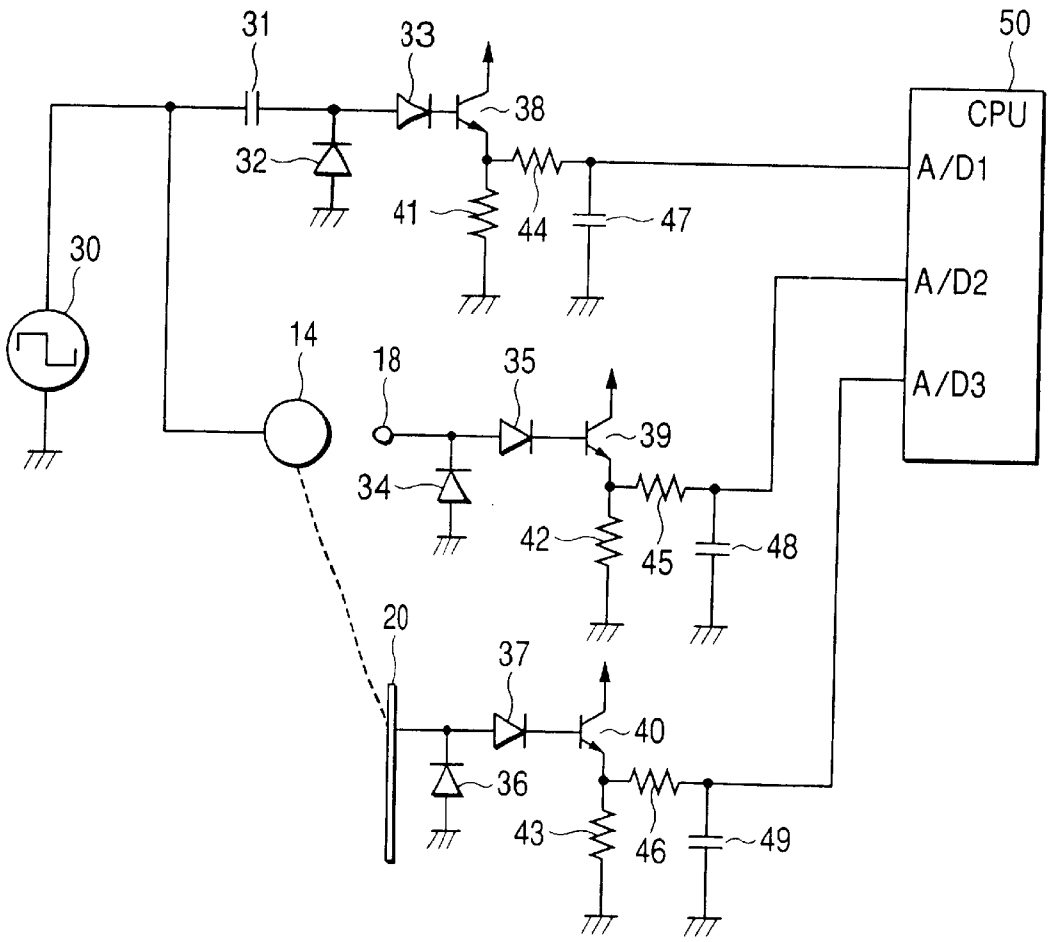
FIG. 14 is a circuit diagram of a toner remaining-amount detecting device according to a sixth embodiment of the present invention.
Figure 15:
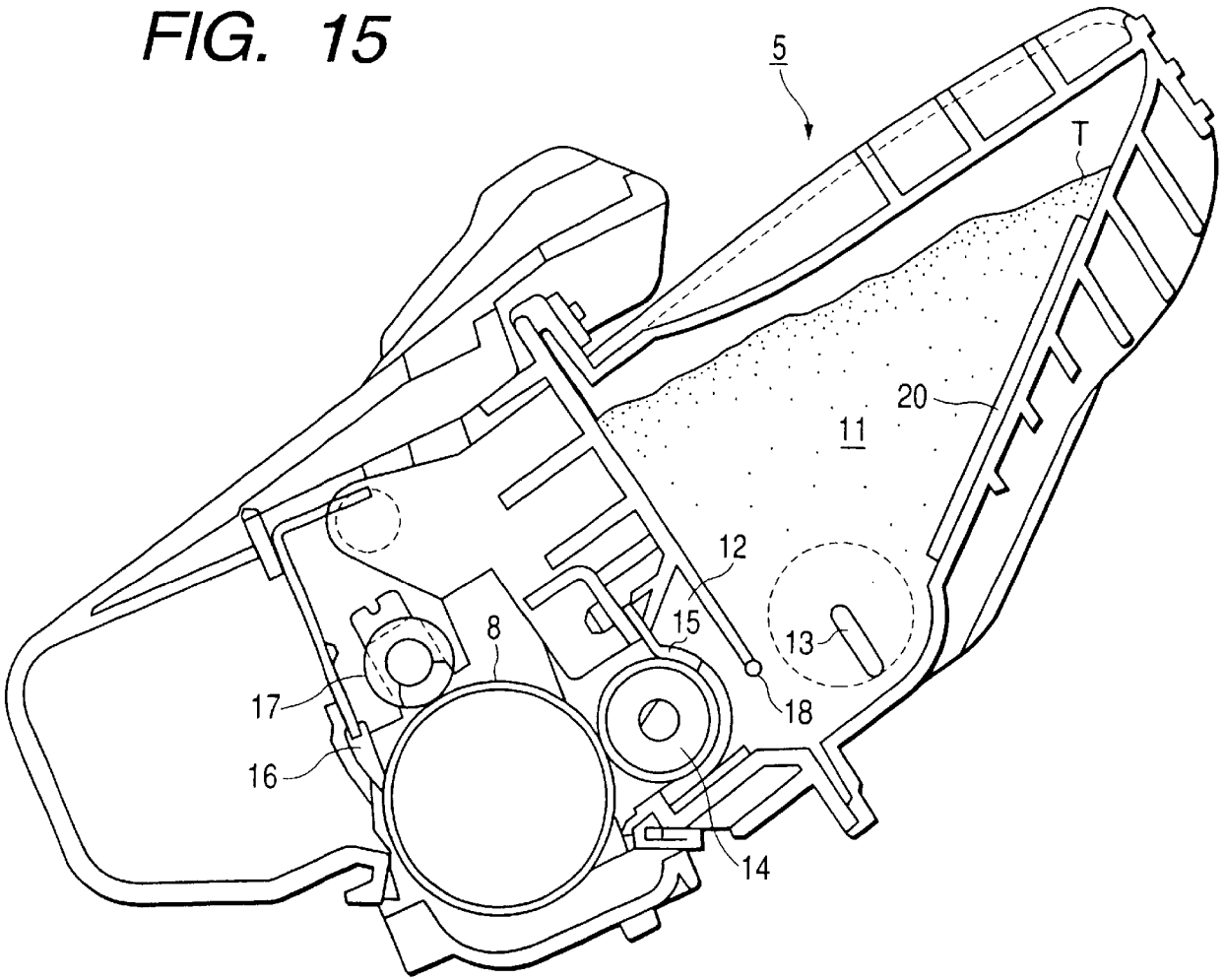
FIG. 15 is a sectional view of a process cartridge having the toner remaining-amount detecting device according to the sixth embodiment of the present invention.

Next, a sixth embodiment of the present invention will be explained with reference to FIGS. 14 and 15. Incidentally, FIG. 14 is a circuit diagram of a toner-remaining-amount detecting device according to a sixth embodiment of the present invention, and FIG. 15 is a sectional view of a process cartridge having such a toner-remaining-amount detecting device. In FIGS. 14 and 15, the same elements as those shown in FIGS. 11 and 13 are designated by the same reference numerals and an explanation thereof will be omitted.

In the fifth embodiment, while the additional electrode plate 59 (FIG. 13) was provided, in the sixth embodiment, a developing cylinder 14 also acts as an electrode. As a result, there is no capacitive coupling between the electrode plate 59 and the first antenna 18, and, thus, the remaining amount of toner in the toner container 11 can be detected accurately by detecting the capacitance between the developing cylinder 14 and the second antenna 20. However, since the capacitance between the developing cylinder 14 and the second antenna 20 is naturally small, there is a disadvantage that the detected output voltage becomes smaller. To cover such disadvantage, it is required that the area of the second antenna 20 be greater than that in the fifth embodiment.

Seventh Embodiment

Figure 16:
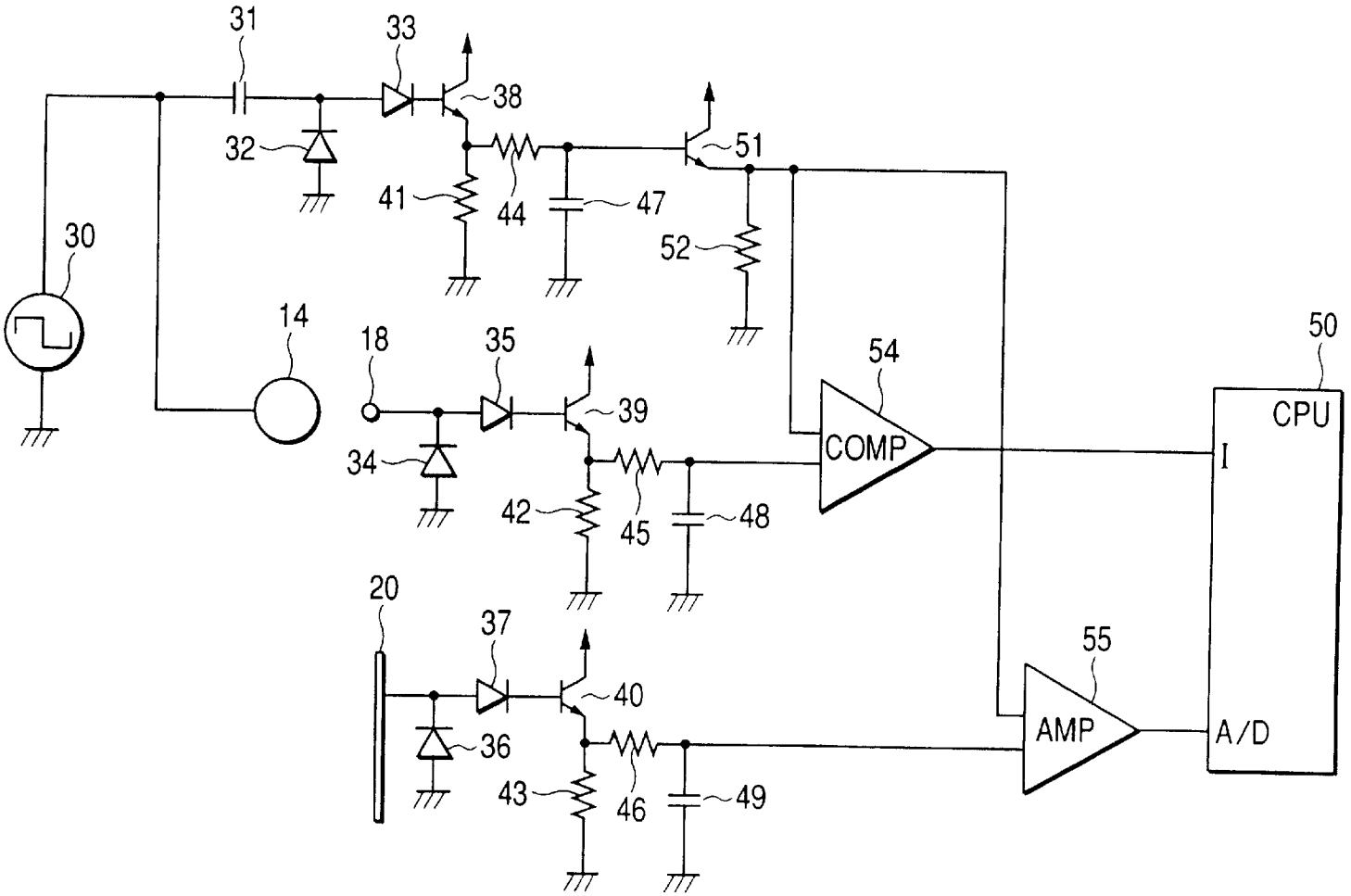
FIG. 16 is a circuit diagram of a toner remaining-amount detecting device according to a seventh embodiment of the present invention.

Next, a seventh embodiment of the present invention will be explained with reference to FIG. 16. Incidentally, FIG. 16 is a circuit diagram of a toner-remaining-amount detecting device according to the seventh embodiment of the present invention. In FIG. 16, the same elements as those shown in FIG. 14 are designated by the same reference numerals and explanation thereof will be omitted.

In the toner-remaining-amount detecting device according to the seventh embodiment, voltages at both ends of the capacitor 47 are further stabilized by a buffer amplifier due to the emitter follower comprised of a transistor 51 and an emitter resistor 52.

There are also provided a comparator (COMP) 54, a differential amplifier (AMP) 55 constituted by an operational amplifier, and a one-chip CPU 50. The CPU 50 is provided with an analog/digital converting input A/D, as well as a general I/O port.

The output passed through the reference capacitor 31 becomes proportional to the fluctuation of output of the developing bias AC power supply 30. It is desirable that the output of the developing bias AC power supply 30 be stable, but the amplitude and rising property of the output are slightly changed from machine to machine or due to a change in load capacity, and such change leads to a fluctuation in the output between the first antenna 18 and the second antenna 20. Such fluctuation causes an error when the toner remaining amount is detected. Therefore when the change in AC voltage is detected through the reference capacitor 31 and when the outputs of the first and second antennas 18, 20 are measured on the basis of the voltage outputted to the end of the capacitor 47, the change in the AC voltage itself can be cancelled.

Thus, in the illustrated embodiment, the rectified output of the first antenna 18 is compared with the rectified output of the reference capacitor 31 by the comparator 54. And, at a time when the antenna output is decreased below a threshold level as the amount of toner is decreased, the output of the comparator 54 is reversed, and such reversed result is inputted to the CPU 50 through the input terminal I of the CPU 50.

Further, a difference between the rectified output of the second antenna 20 and the rectified output of the reference capacitor 31 is amplified by the differential amplifier 55, and the amplified output is inputted to the CPU 50 through the A/D port.

Since the output of the reference capacitor 31 is used as reference capacitor voltages for the comparator 54 and the differential amplifier 55, the fluctuated component of the developing bias AC power source 30 can be eliminated, thereby permitting accurate toner-remaining-amount detection. Further, regarding the first antenna 18, when the antenna output decreases below the threshold level, no toner signal may be obtained at a critical limit that further image formation cannot be achieved, and, upon generation of such a signal, the image forming operation may be stopped or warning may be indicated to the operator on the basis of the judgement of the CPU 50.

Further, the second antenna 20 may detect the difference between the second antenna voltage and the reference voltage, so that the toner amount decreased as the increased printing time is inputted to the CPU 50, thereby informing the operator of the toner-decreasing state sequentially.

Eighth Embodiment

Figure 17:
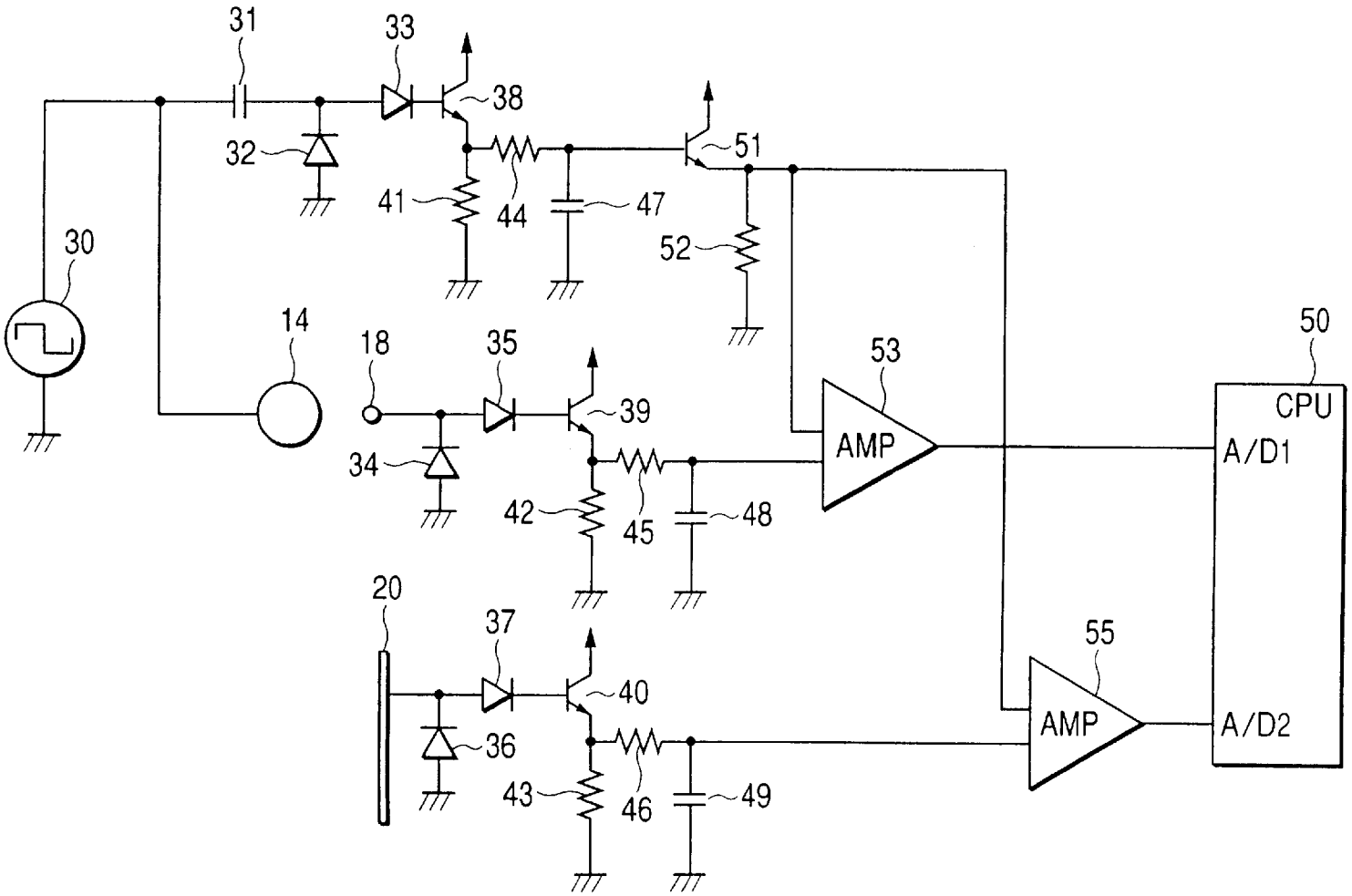
FIG. 17 is a circuit diagram of a toner remaining-amount detecting device according to an eighth embodiment of the present invention.

Next, an eighth embodiment of the present invention will be explained with reference to FIG. 17. Incidentally, FIG. 17 is a circuit diagram of a toner-remaining-amount detecting device according to the eighth embodiment of the present invention. In FIG. 17, the same elements as those shown in FIG. 16 are designated by the same reference numerals and explanation thereof will be omitted.

In the above-mentioned seventh embodiment, while an example that the comparator 54 is used as comparing means for the rectified output of the first antenna 18 was explained, the comparator merely judges whether the amount of toner remaining in the developing chamber 12 is sufficient to permit the image formation or not. In order to stop the image formation if the toner amount becomes insufficient, the output of the comparator 54 may be reversed when the toner amount is decreased below a certain level. However, it is more preferable to measure the absolute value of the amount of toner lastly remained. In this case, it is required that the amount of toner be detected linearly.

To this end, in the illustrated embodiment, the comparator 54 shown in FIG. 16 is replaced by a differential amplifier 53 and a port A/D1 is used for input to the CPU 50. Further, the output of the differential amplifier 55 of the second antenna 20 is inputted to a port A/D2 of the CPU 50.

With this arrangement, linear outputs of the first and second antenna 18, 20 can be obtained, and, thus, the state of toner decreased over the printing time can be known.

Ninth Embodiment

Figure 18:
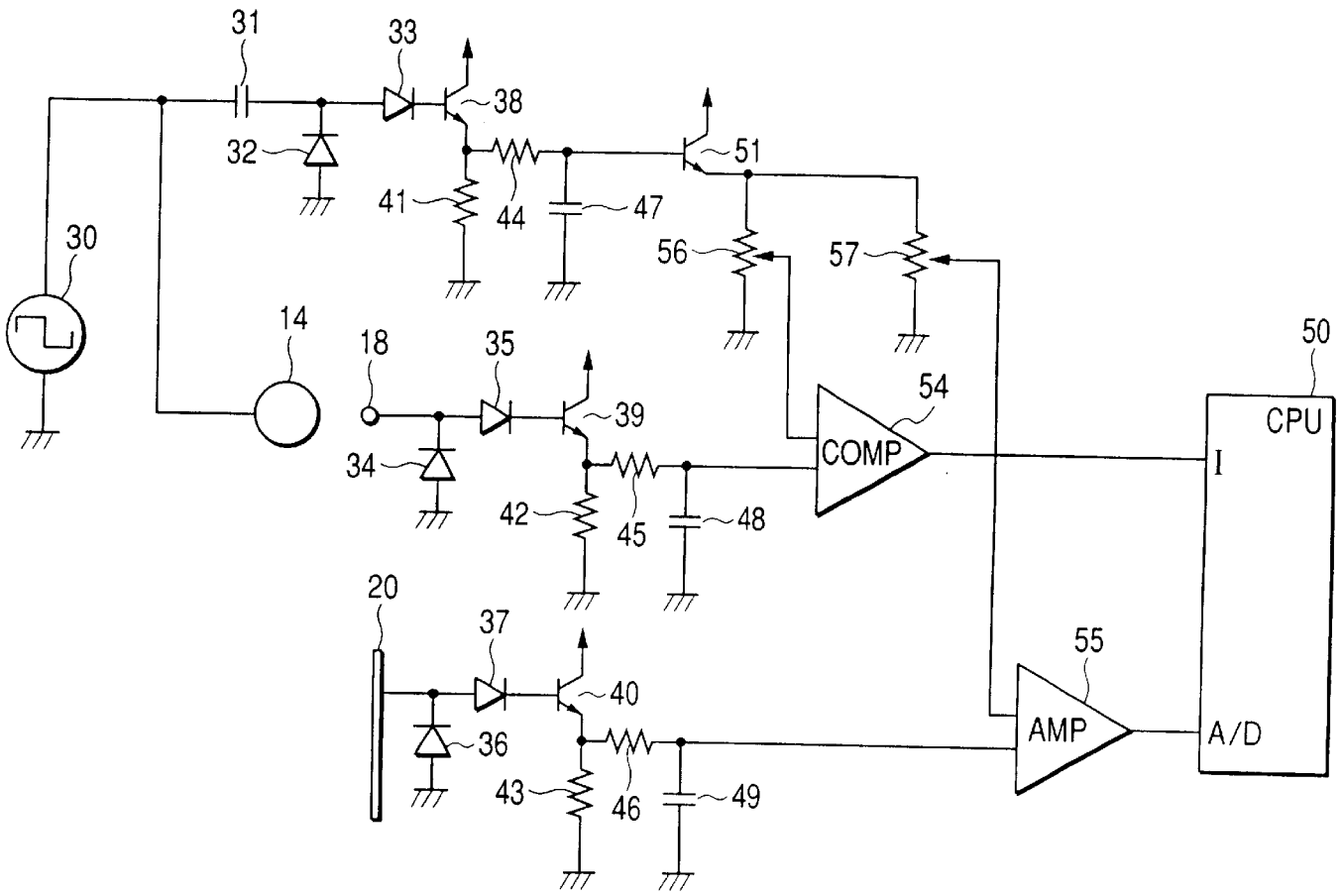
FIG. 18 is a circuit diagram of a toner remaining-amount detecting device according to a ninth embodiment of the present invention.

Next, a ninth embodiment of the present invention will be explained with reference to FIG. 18. Incidentally, FIG. 18 is a circuit diagram of a toner-remaining-amount detecting device according to the ninth embodiment of the present invention. In FIG. 18, the same elements as those shown in FIG. 16 are designated by the same reference numerals and explanation thereof will be omitted.

In the toner-remaining-amount detecting device according to the ninth embodiment, voltages at both ends of the capacitor 47 are further stabilized by a buffer amplifier due to an emitter follower comprised of a transistor 51, and the output is voltage-divided by variable resistances 56, 57.

There are also provided a comparator (COMP) 54, a differential amplifier (AMP) 55 constituted by an operational amplifier, and a one-chip CPU 50. The CPU 50 is provided with an analog/digital converting input A/D, as well as a general I/O port.

The output passed through the reference capacitor 31 becomes proportional to the fluctuation of output of the developing bias AC power supply 30. It is desirable that the output of the developing bias AC power supply 30 is stable, but the amplitude and rising property of the output are slightly changed from machine to machine or due to change in load capacity, and such change leads to a fluctuation in the output between the first antenna 18 and the second antenna 20. Such fluctuation causes an error when the toner remaining amount is detected. Therefore, when the change in AC voltage is detected through the reference capacitor 31 and when the outputs of the first and second antennas 18, 20 are measured on the basis of the voltage outputted to the end of the capacitor 47, the change in the AC voltage itself can be cancelled.

Thus, in the illustrated embodiment, the rectified output of the first antenna 18 is compared with the rectified output of the reference capacitor 31 by the comparator 54. And, at a time when the antenna output is decreased below a threshold level as the amount of toner is decreased, the output of the comparator 54 is reversed, and such reversed result is inputted to the CPU 50 through the input terminal I of the CPU 50.

Further, a difference between the rectified output of the second antenna 20 and the rectified output of the reference capacitor 31 is amplified by the differential amplifier 55, and the amplified output is inputted to the CPU 50 through the A/D port.

Since the output of the reference capacitor 31 is used as reference capacitor voltages for the comparator 54 and the differential amplifier 55, the fluctuated component of the developing bias AC power source 30 can be eliminated, thereby permitting accurate toner-remaining-amount detection. Further, regarding the first antenna 18, when the antenna output decreases below the threshold level, no toner signal may be obtained at a critical limit that further image formation cannot be achieved, and, upon generation of such a signal, the image forming operation may be stopped or warning may be indicated to the operator on the basis of judgement of the CPU 50.

Further, the second antenna 20 may detect the difference between the second antenna voltage and the reference voltage, so that the toner amount decreased over the printing time is inputted to the CPU 50, thereby informing the operator of the toner decreasing state sequentially.

By the way, due to factors, such as dispersion in configuration and attachment accuracy for antennas 18, 20 and dispersion in the straight capacity of every wiring to the antennas 18, 20, there is dispersion in sensitivity for antennas 18, 20. However, the dispersion in sensitivity of the antennas 18, 20 can be adjusted by the variable resistances 56, 57.

Tenth Embodiment

Figure 19:
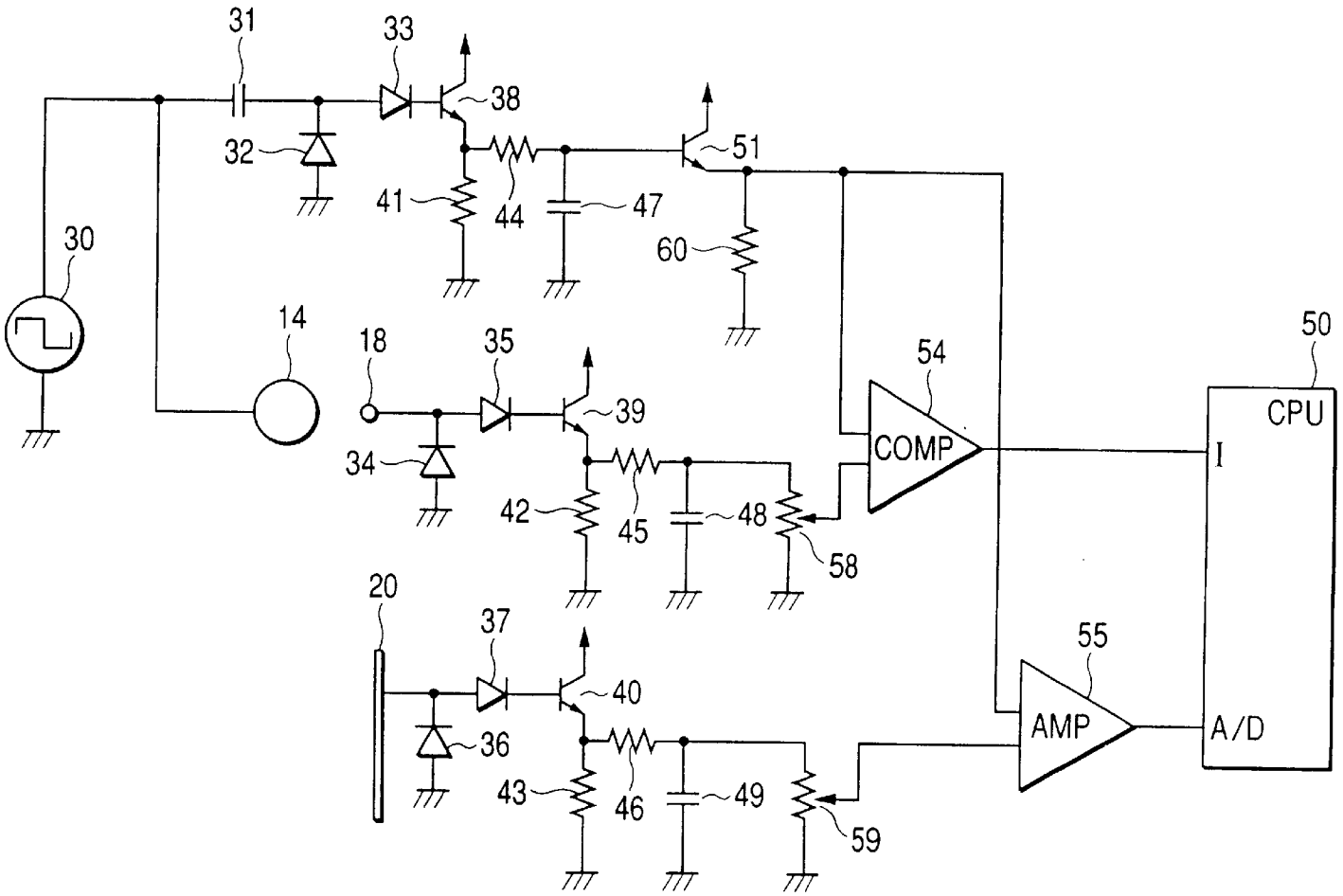
FIG. 19 is a circuit diagram of a toner remaining-amount detecting device according to a tenth embodiment of the present invention.

Next, a tenth embodiment of the present invention will be explained with reference to FIG. 19. Incidentally, FIG. 19 is a circuit diagram of a toner-remaining-amount detecting device according to the tenth embodiment of the present invention. In FIG. 19, the same elements as those shown in FIG. 18 are designated by the same reference numerals and explanation thereof will be omitted.

In the ninth embodiment, while the output of the transistor 51 was voltage-divided, in the embodiment, the output of the transistor 51 is fixed by using a resistance 60. Further, output portions of the first and second antennas 18, 20 (i.e., output portions of the capacitors 48, 49) are connected to variable resistors 58, 59 so that the output voltages can be voltage-divided and adjusted.

According to the illustrated embodiment, since the dispersion in sensitivity of the first and second antennas 18, 20 can be corrected, the same effect as the fifth embodiment can be achieved.

Incidentally, as is in the transistor 51 for the reference capacitor 31, by providing the buffer of the emitter follower, when the voltage-dividing resistances are changed, the toner-remaining-amount detecting accuracy can be improved by preventing fluctuation in voltages of the capacitors 48, 49.

As apparent from the above explanation, according to the present invention, the toner remaining amount can be detected sequentially.

Further, according to the present invention, the toner remaining amount can be detected accurately.

While the invention has been described with reference to the structures disclosed herein, it is not confined to the details set forth and this application is intended to cover such modifications or changes as may come within the purposes of the improvements or the scope of the following claims.

What is claimed is:

1. A toner remaining amount detecting device to successively detect an amount of toner contained in a developing device for developing a latent image formed on an electrophotographic photosensitive member by a developing member with use of said toner, said developing device being detachably mountable to a main body of an electrophotographic image forming apparatus, said toner remaining amount detecting device comprising:

a first electrode formed independently of a wall member of said developing device, said wall member defining a path through which said toner is supplied to said developing member, said first electrode being disposed on said wall member;

a second electrode disposed in said developing device so that said toner can exist in a spatial region between said first and second electrodes; and capacitance detecting means for successively detecting a capacitance between said first and second electrodes, wherein the amount of said toner is detected successively based on said capacitance.

2. A toner remaining amount detecting device according to claim 1, wherein said first electrode is contacted with an outer side of said wall member.

3. A toner remaining amount detecting device according to claim 1, wherein said first electrode is contacted with an inner side of said wall member.

4. A toner remaining amount detecting device according to claim 1, 2, or 3, wherein said second electrode is disposed in a developing chamber of said developing device.

5. A toner remaining amount detecting device according to claim 4, wherein said second electrode is a developing sleeve.

6. A toner remaining amount detecting device according to any one of claims 1 to 3, further comprising a conductive antenna opposed to said second electrode so that said toner exists between said antenna and said second electrode.

7. A toner remaining amount detecting method to successively detect an amount of toner contained in a developing device for developing a latent image formed on an electrophotographic photosensitive member by a developing member with use of said toner, said developing device being detachably mountable to a main body of an electrophotographic image forming apparatus, said toner remaining amount detecting method comprising the steps of:

providing a first electrode formed independently of a wall member of said developing device, said wall member defining a path through which said toner is supplied to said developing member, said first electrode being disposed on said wall member;

providing a second electrode disposed in said developing device so that said toner can exist in a spatial region between said first and second electrodes; and detecting a capacitance between said first and second electrodes successively to detect the amount of said toner successively.

8. A toner remaining amount detecting method according to claim 7, wherein said first electrode is contacted with an outer side of said wall member.

9. A toner remaining amount detecting method according to claim 7, wherein said first electrode is contacted with an inner side of said wall member.

10. A toner remaining amount detecting method according to claim 7, 8, or 9, wherein said second electrode is disposed in a developing chamber of said developing device.

11. A toner remaining amount detecting method according to claim 10, wherein said second electrode is a developing sleeve.

12. A toner remaining amount detecting method according to any one of claims 7 to 9, further comprising the step of providing a conductive antenna opposed to said second electrode so that said toner exists between said antenna and said second electrode.

13. A process cartridge detachably mountable to a main body of an image forming apparatus, said process cartridge comprising:

(a) an electrophotographic photosensitive member;

(b) a developing member for developing an electrostatic latent image formed on said electrophotographic photosensitive member using toner;

(c) a first electrode formed independently of a wall member of said process cartridge, said wall member defining a path through which said toner is supplied to said developing member, said first electrode being disposed on said wall member;

(d) a second electrode disposed in said process cartridge so that said toner can exist in a spatial region between said first and second electrodes; and (e) an electrical contact for transmitting a signal corresponding to a capacitance between said first and second electrodes to said main body of said electrophotographic image forming apparatus when the process cartridge is mounted to said main body of said electrophotographic image forming apparatus, wherein a remaining amount of said toner in said process cartridge can be detected successively in said main body of said electrophotographic image forming apparatus.

14. A process cartridge according to claim 13, wherein said first electrode is contacted with an outer side of said wall member.

15. A process cartridge according to claim 13, wherein said first electrode is contacted with an inner side of said wall member.

16. A process cartridge according to claim 13, 14, or 15, wherein said second electrode is disposed in a developing chamber of said process cartridge for.

17. A process cartridge according to claim 16, wherein said second electrode is a developing sleeve and wherein said developing member comprises said developing sleeve.

18. A process cartridge according to any one of claims 13 to 15, further comprising a conductive antenna opposed to said second electrode so that said toner exists between said antenna and said second electrode.

19. An electrophotographic image forming apparatus to which a process cartridge is detachably mountable for forming an image on a recording medium, said electrophotographic image forming apparatus comprising:

(a) a process cartridge including an electrophotographic photosensitive member, a developing member for developing a latent image formed on said electrophotographic photosensitive member using toner, a first electrode formed independently of a wall member of said process cartridge, said wall member defining a path through which said toner is supplied to said developing member, said first electrode being disposed on said wall member, a second electrode disposed in said process cartridge so that said toner can exist in a spatial region between said first and second electrodes, and an electrical contact for transmitting a signal corresponding to a capacitance between said first and second electrodes to a main body of said electrophotographic image forming apparatus when the process cartridge is mounted to the main body of said electrophotographic image forming apparatus;

(b) capacitance detecting means for receiving the signal from said electrical contact and for successively detecting the capacitance between said first and second electrodes; and (c) informing means for informing a user of said electrophotographic image forming apparatus of a remaining of said toner on the basis of a detected result from said capacitance detecting means.

20. An electrophotographic image forming apparatus according to claim 19, wherein said first electrode is contacted with an outer side of said wall member.

21. An electrophotographic image forming apparatus according to claim 19, wherein said first electrode is contacted with an inner side of said wall member.

22. An electrophotographic image forming apparatus according to claim 19, 20 or 21, wherein said second electrode is disposed in a developing chamber of said process cartridge.

23. An electrophotographic image forming apparatus according to claim 22, wherein said second electrode is a developing sleeve.

24. An electrographic image forming apparatus according to any one of claims 19 to 21, further comprising a conductive antenna opposed to said second electrode so that said toner exists between said antenna and said second electrode.

25. A process cartridge detachably mountable to a main body of an electrophotographic image forming apparatus, said process cartridge comprising:

an electrophotographic photosensitive member;

a charging member for charging said electrophotographic photosensitive member;

a developing member for developing a latent image formed on said electrophotographic photosensitive member using toner;

an electrode disposed so that said toner can exist in a spatial region between said developing member and said electrode, said electrode being formed independently of a wall member of said process cartridge, said wall member defining a path through which said toner is supplied to said developing member, and said electrode being an electrode plate disposed on an inner side of said wall member; and an electrical contact for transmitting an electrical signal corresponding to a capacitance between said developing member and said electrode to said main body of said electrophotographic image forming apparatus to successively detect a remaining amount of said toner in said process cartridge when said process cartridge is mounted to said main body of said electrophotographic image forming apparatus, whereby the amount of said toner in said process cartridge can be detected successively in said main body of said electrophotographic image forming apparatus.

26. An electrophotographic image forming apparatus to which a process cartridge is detachably mountable for forming an image on a recording medium, said electrophotographic image forming apparatus comprising:

(a) a mounting portion for detachably mounting said process cartridge, said process cartridge including:

an electrophotographic photosensitive member;

a charging member for charging said electrophotographic photosensitive member;

a developing member for developing a latent image formed on said electrophotographic photosensitive member using toner;

an electrode disposed so that said toner can exist in a spatial region between said developing member and said electrode, said electrode being formed independently of a wall member of said process cartridge, said wall member defining a path through which said toner is supplied to said developing member, and said electrode being an electrode plate disposed on an inner side of said wall member; and an electrical contact for transmitting an electrical signal corresponding to a capacitance between said developing member and said electrode to a main body of said electrophotographic image forming apparatus to successively detect a remaining amount of said toner in said process cartridge when said process cartridge is mounted to the main body of said electrophotographic image forming apparatus; and (b) toner remaining amount detecting means for receiving the electrical signal from said electrical contact of said process cartridge mounted to said mounting portion to successively detect the remaining amount of said toner in said process cartridge.

27. An electrophotographic image forming apparatus according to claim 26, further comprising informing means for informing a user of said electrophotographic image forming apparatus of the remaining amount of said toner on the basis of a detected result of said toner amount detecting means.

28. A process cartridge detachably mountable to a main body of an electrophotographic image forming apparatus, said process cartridge comprising:

an electrophotographic photosensitive member;

a charging member for charging said electrophotographic photosensitive member;

a developing member for developing a latent image formed on said electrophotographic photosensitive member using toner;

an electrode disposed so that said toner can exist in a spatial region between said developing member and said electrode, said electrode being formed independently of a wall member of said process cartridge, said wall member defining a path through which said toner is supplied to said developing member, and said electrode being an electrode plate disposed on an outer side of said wall member; and an electrical contact for transmitting an electrical signal corresponding to a capacitance between said developing member and said electrode to said main body of said electrophotographic image forming apparatus to successively detect a remaining amount of said toner in said process cartridge when said process cartridge is mounted to said main body of said electrophotographic image forming apparatus, whereby the amount of said toner in said process cartridge can be detected successively in said main body of said electrophotographic image forming apparatus.

29. An electrophotographic image forming apparatus to which a process cartridge is detachably mountable for forming an image on a recording medium, said electrophotographic image forming apparatus comprising:

(a) a mounting portion for detachably mounting said process cartridge, said process cartridge including:

an electrophotographic photosensitive member;

a charging member for charging said electrophotographic photosensitive member;

a developing member for developing a latent image formed on said electrophotographic photosensitive member using toner;

an electrode disposed so that said toner can exist in a spatial region between said developing member and said electrode, said electrode being formed independently of a wall member of said process cartridge, said wall member defining a path through which said toner is supplied to said developing member, and said electrode being an electrode plate disposed on an outer side of said wall member; and an electrical contact for transmitting an electrical signal corresponding to a capacitance between said developing member and said electrode to a main body of said electrophotographic image forming apparatus to successively detect a remaining amount of said toner in the process cartridge when said process cartridge is mounted to said main body of said electrophotographic image forming apparatus; and (b) toner remaining amount detecting means for receiving the electrical signal from said electrical contact of said process cartridge mounted to said mounting portion to successively detect the remaining amount of said toner in said process cartridge.

30. An electrophotographic image forming apparatus according to claim 29, further comprising informing means for informing a user of said electrophotographic image forming apparatus of the remaining amount of said toner on the basis of a detected result of said toner remaining amount detecting means.

31. A process cartridge detachably mountable to a main body of an electrophotographic image forming apparatus, said process cartridge comprising:

an electrophotographic photosensitive member;

a charging member for charging said electrophotographic photosensitive member;

a developing member for developing a latent image formed on said electrophotographic photosensitive member using toner;

an electrode disposed so that said toner can exist in a spatial region between said developing member and said electrode, said electrode being formed independently of a wall member of said process cartridge, said wall member defining a path through which said toner is supplied to said developing member, and said electrode being an electrode plate disposed along a path along which said toner is decreased; and an electrical contact for transmitting an electrical signal corresponding to a capacitance between said developing member and said electrode to said main body of said electrophotographic image forming apparatus to successively detect a remaining amount of said toner in said process cartridge when said process cartidge is mounted to said main body of said electrophotographic image forming apparatus, whereby the remaining amount of said toner in said process cartridge can be detected successively in said main body of said electrophotographic image forming apparatus.

32. A process cartridge according to claim 31, wherein said electrode plate is contacted with an outer side of a wall member of said process cartridge.

33. A process cartridge according to claim 31, wherein said electrode plate is contacted with an inner side of a wall member of said process cartridge.

34. A process cartridge according to any one of claims 25, 28, or 31, wherein said electrode plate has a curved shape.

35. An electrophotographic image forming apparatus to which a process cartridge is detachably mountable for forming an image on a recording medium, said electrophotographic image forming apparatus comprising:

(a) a mounting portion for detachably mounting said process cartridge, said process cartridge including:
an electrophotographic photosensitive member;
a charging member for charging said electrophotographic photosensitive member;
a developing member for developing a latent image formed on said electrophotographic photosensitive member using toner;
an electrode disposed so that said toner can exist in a spatial region between said developing member and said electrode, said electrode being formed independently of a wall member of said process cartridge, said wall member defining a path through which said toner is supplied to said developing member, and said electrode being an electrode plate disposed along a path along which said toner is decreased; and
an electrical contact for transmitting an electrical signal corresponding to a capacitance between said developing member and said electrode to a main body of said electrophotographic image forming apparatus to succesively detect a remaining amount of said toner in said process cartridge when said process cartridge is mounted to the main body of said electrophotographic image forming apparatus; and (b) toner remaining amount detecting means for receiving the electrical signal from said electrical contact of said process cartridge mounted to said mounting portion to successively detect the remaining amount of said toner in said process cartridge.

36. An electrophotographic image forming apparatus according to claim 35, further comprising informing means for informing a user of said electrophotographic image forming apparatus to the remaining amount of said toner on the basis of a detected result of said toner remaining amount detecting means.

* * * * *

UNITED STATES PATENT AND TRADEMARK OFFICE

CERTIFICATE OF CORRECTION

PATENT NO. : 6,415,112 B1
DATED : July 2, 2002
INVENTOR(S) : Junichi Kimizuka et al.

It is certified that error appears in the above-identified patent and that said Letters Patent is hereby corrected as shown below:

Column 1,
Line 46, “not” should read -- not be --.

Column 4,
Line 9, “serve” should read -- serves --.
Line 27, “a” should read -- the --.
Line 28, “capacitance” should read -- the capacitance --.
Line 34, “dispersion” should read -- the dispersion --.

Column 6,
Line 32, “Further” should read -- further --.
Line 37, “maximum” should read -- a maximum) --.
Line 40, “minimum)” should read -- a minimum) --.
Line 45, “minimum.” should read -- a minimum. --.

Column 8,
Line 43, “roller 4,” should read -- rollers 4, --.
Line 50, “invent” should read -- latent --.

Column 15,
Line 39, “cartridge for.” should read -- cartridge. --.

Signed and Sealed this

Fourth Day of March, 2003

JAMES E. ROGAN
*Director of the United States Patent and Trademark Office*